US010279945B2

(12) United States Patent
Nelson et al.

(10) Patent No.: US 10,279,945 B2
(45) Date of Patent: May 7, 2019

(54) STRETCH FILM ROPING

(71) Applicant: Encore Packaging LLC, Lake Bluff, IL (US)

(72) Inventors: Timothy H. Nelson, Winnetka, IL (US); Stephenson Nelson, Winnetka, IL (US); John Parks, Mundelein, IL (US)

(73) Assignee: Encore Packaging LLC, Vernon Hills, IL (US)

( * ) Notice: Subject to any disclaimer, the term of this patent is extended or adjusted under 35 U.S.C. 154(b) by 758 days.

(21) Appl. No.: 14/674,255

(22) Filed: Mar. 31, 2015

(65) Prior Publication Data

US 2015/0203232 A1 Jul. 23, 2015

Related U.S. Application Data

(63) Continuation-in-part of application No. 13/920,189, filed on Jun. 18, 2013, now Pat. No. 9,682,790, which (Continued)

(51) Int. Cl.

| | |
|---|---|
| ***B65B 67/08*** | (2006.01) |
| ***B65H 16/04*** | (2006.01) |
| ***B65H 23/06*** | (2006.01) |
| ***B65H 75/08*** | (2006.01) |
| ***B65D 71/00*** | (2006.01) |
| ***B65B 61/02*** | (2006.01) |
| ***B65B 11/00*** | (2006.01) |

(Continued)

(52) U.S. Cl.

CPC ..... *B65B 67/085* (2013.01); *B65B 11/006* (2013.01); *B65B 11/045* (2013.01); *B65B 61/02* (2013.01); *B65D 71/0096* (2013.01); *B65H 16/04* (2013.01); *B65H 23/06* (2013.01); *B65H 75/08* (2013.01); *B65B 65/02* (2013.01); *B65D 2571/00018* (2013.01); *B65H 2402/412* (2013.01); *B65H 2701/1944* (2013.01)

(58) Field of Classification Search

CPC ..... B65B 11/006; B65B 11/045; B65B 67/08; B65B 67/085

USPC ..... 53/441, 461, 466, 556, 210, 211

See application file for complete search history.

(56) References Cited

U.S. PATENT DOCUMENTS

| | | | |
|---|---|---|---|
| 1,895,766 | A | 1/1933 | Murphy |
| 2,351,525 | A | 6/1944 | Leary |

(Continued)

FOREIGN PATENT DOCUMENTS

| | | | |
|---|---|---|---|
| WO | 9207761 | A1 | 5/1992 |

OTHER PUBLICATIONS

Western Plastics Internet Page; "Air-Flow Overview"; http://www.wplastics.com/articles/af_article_004.asp; 2 pages. Available at least as early as Mar. 9, 2013.

(Continued)

*Primary Examiner* — Alexander Valvis
*Assistant Examiner* — Valentin Neacsu
(74) *Attorney, Agent, or Firm* — Fitch, Even, Tabin & Flannery LLP

(57) ABSTRACT

A stretch film dispensing apparatus gathers the stretch film into a string or rope for use in securing an object to a pallet for shipping. The stretch film can be converted into a string or rope by passing it through one or more of a hook, funnel, apparatus, set of gears, or the like to effect stretching and/or twisting of the film into a string or rope.

14 Claims, 45 Drawing Sheets

Related U.S. Application Data is a continuation-in-part of application No. 13/827,787, filed on Mar. 14, 2013, which is a continuation-in-part of application No. 13/797,372, filed on Mar. 12, 2013.

(60) Provisional application No. 61/716,666, filed on Oct. 22, 2012, provisional application No. 61/972,540, filed on Mar. 31, 2014, provisional application No. 61/990,515, filed on May 8, 2014, provisional application No. 62/029,099, filed on Jul. 25, 2014, provisional application No. 62/067,517, filed on Oct. 23, 2014.

(51) Int. Cl.
*B65B 11/04* (2006.01)
*B65B 65/02* (2006.01)

(56) References Cited

U.S. PATENT DOCUMENTS 2,385,209 A 9/1945 Joyce
2,564,517 A 8/1951 Beals
D172,029 S 4/1954 Johnson
3,492,389 A * 1/1970 Port ..... D01D 5/423 264/147
3,754,636 A 8/1973 Boy
3,759,169 A 9/1973 Goodley
3,836,106 A 9/1974 Gray
3,969,793 A 7/1976 Crosby
4,009,235 A * 2/1977 Bober ..... B29B 17/0026 264/141
4,102,513 A 7/1978 Guard
4,166,589 A 9/1979 Hoover
4,255,918 A 3/1981 Lancaster
4,271,657 A * 6/1981 Lancaster, III ..... B65B 11/045 53/138.4
4,336,679 A 6/1982 Lancaster
4,387,552 A 6/1983 Lancaster
4,432,185 A * 2/1984 Geisinger ..... B65B 11/045 53/138.2
4,502,911 A 3/1985 Discavage
4,535,951 A 8/1985 Riemenschneider
4,605,456 A 8/1986 Annis, Jr.
4,671,043 A 6/1987 Forni
D295,525 S 5/1988 Sakaki
4,807,427 A * 2/1989 Casteel ..... B65B 11/006 53/389.2
4,905,451 A 3/1990 Jaconelli
D307,435 S 4/1990 Sakaki
D308,977 S 7/1990 Sakaki
5,125,209 A 6/1992 Thimon
5,139,403 A * 8/1992 Stuart ..... B29B 9/00 425/111
5,168,685 A 12/1992 Suzuki
5,447,009 A 9/1995 Oleksy
5,452,566 A * 9/1995 Benhamou ..... B65B 11/025 53/389.3
5,463,843 A * 11/1995 Sharp ..... B65B 11/006 53/399
5,531,393 A 7/1996 Salzsauler
D393,201 S 4/1998 Hearidge
5,775,084 A * 7/1998 Bernhardy ..... D02G 3/06 264/103
5,884,857 A 3/1999 Martin-Cocher
D415,570 S 10/1999 Bradshaw
6,009,681 A 1/2000 Kozloff
D424,078 S 5/2000 Chin-Chang
D448,987 S 10/2001 Davis
6,360,512 B1 * 3/2002 Marois ..... B65B 11/006 53/399
6,450,515 B1 9/2002 Guth
6,463,721 B1 10/2002 Su
6,568,159 B2 5/2003 Kawai
6,663,069 B1 12/2003 Norberg
D488,822 S 4/2004 Shibazaki et al.
6,745,544 B2 * 6/2004 Matsumoto ..... B65B 11/006 53/176
6,745,678 B1 6/2004 Liu
6,789,469 B1 9/2004 Tipton
6,874,297 B2 4/2005 Solis
6,994,019 B1 2/2006 Liu
D545,183 S 6/2007 French
D546,852 S 7/2007 Shimojima
D547,779 S 7/2007 Shimojima
7,263,928 B1 9/2007 Holden
7,270,055 B1 9/2007 Haberstroh
D552,463 S 10/2007 French
7,357,349 B1 4/2008 Huang
D578,383 S 10/2008 Adams
7,581,368 B1 * 9/2009 Bison ..... B65B 11/006 53/399
D608,189 S 1/2010 Jackson
7,779,607 B2 8/2010 Lancaster
7,908,831 B1 * 3/2011 Dugan ..... B65B 11/006 53/211
8,037,660 B2 10/2011 Lancaster
8,053,056 B2 11/2011 Heikaus
8,099,935 B2 1/2012 Forni
D663,357 S 7/2012 Bookhamer
D669,773 S 10/2012 Colasse
8,276,346 B2 10/2012 Lancaster
8,276,354 B2 10/2012 Lancaster
D675,512 S 2/2013 Gary
8,549,819 B1 * 10/2013 Bison ..... B65B 11/585 53/176
8,707,664 B1 * 4/2014 Bison ..... B65B 11/585 53/441
D729,025 S 5/2015 Chance
9,850,011 B2 12/2017 Nelson
2003/0009995 A1 1/2003 Pearson
2004/0098953 A1 5/2004 Devine
2004/0255562 A1 12/2004 Haberstroh
2004/0255797 A1 12/2004 Bobren
2005/0044812 A1 * 3/2005 Lancaster, III ..... B65B 11/006 53/399
2005/0061165 A1 3/2005 Powers
2005/0123721 A1 6/2005 Heikaus
2007/0095991 A1 5/2007 Fall
2007/0197117 A1 8/2007 Austin
2007/0204565 A1 9/2007 Lancaster
2010/0037562 A1 * 2/2010 Forni ..... B65B 11/045 53/461
2010/0154661 A1 6/2010 Bobren
2011/0120056 A1 5/2011 Smith
2011/0120321 A1 5/2011 Oehm
2011/0233321 A1 9/2011 Yu Chen
2012/0216688 A1 8/2012 Liu
2013/0104754 A1 * 5/2013 Van Amstel ..... A01F 15/0715 100/3
2014/0109523 A1 4/2014 Nelson
2014/0331609 A1 11/2014 Bison

OTHER PUBLICATIONS

Western Plastics Internet Page; "Air-Flow Premium Stretches 200% and Works on All Brand Name Equipment"; http://www.wplastics.com/airflow_premium.asp; 2 pages. Available at least as early as Mar. 9, 2013.
Western Plastics Internet Page; "Air-Flow Premium"; http://www.wplastics.com/pg_ind_page12.asp; 2 pages. Available at least as early as Mar. 9, 2013.
Western Plastics Internet Page; "Air-Flow Sales Soar!"; http://www.wplastics.com/airflow.asp; 2 pages. Available at least as early as Mar. 9, 2013.
Western Plastics Internet Page; 'Air-Flow'; http://www.wplastics.com/pg_ind_page11.asp; 2 pages. Available at least as early as Mar. 9, 2013.

(56) References Cited

OTHER PUBLICATIONS

Western Plastics Internet Page; 'Can Air-Flow Solve Your Problems?'; http://www.wplastics.com/articles/af article_003.asp; 2 pages. Available at least as early as Mar. 9, 2013.
Western Plastics Internet Page; "Distributor's Air-Flow Hit List"; http://www.wplastics.com/articles/af_article_002. asp; 2 pages. Available at least as early as Mar. 9, 2013.
Western Plastics Internet Page; "How to Apply Air-Flow for the Best Results"; http://www.wplastics.com/articles/af article_006. asp; 2 pages. Available at least as early as Mar. 9, 2013.
Western Plastics Internet Page; 'Seven Reasons Why You Should Sell Air-Flow'; http://www.wplastics.com/articles/af article_001. asp; 2 pages. Available at least as early as Mar. 9, 2013.

* cited by examiner

STRETCH FILM ROPING

RELATED APPLICATIONS

This application is a continuation in part of U.S. application Ser. No. 13/920,189 filed Jun. 18, 2013, which is a continuation in part of U.S. application Ser. No. 13/827,787 filed Mar. 14, 2013, which is a continuation in part of U.S. application Ser. No. 13/797,372 filed Mar. 12, 2013, which claims the benefit of U.S. provisional patent application No. 61/716,666 filed Oct. 22, 2012, and this application claims the benefit of U.S. provisional patent application No. 61/972,540 filed Mar. 31, 2014, U.S. provisional patent application No. 61/990,515 filed May 8, 2014, U.S. provisional patent application No. 62/029,099 filed Jul. 25, 2014, and U.S. provisional patent application No. 62/067,517 filed Oct. 23, 2014, all of which are incorporated by reference herein in their entireties.

TECHNICAL FIELD

The invention relates generally to the packaging industry and, more specifically, to application of stretch film or wrap to objects.

BACKGROUND

Stretch film or wrap is generally known in the industry as a material that can be used to securely wrap a collection of objects together using the stretch material's resiliency and clinginess. Stretch wrap is typically understood to be a polyethylene stretch film that is generally dispensed from a roll form for use in a variety of applications. For instance, stretch wrap is held against a collection of objects and dispensed and stretched around the collection of objects and wrapped over itself up to several times to cover and hold together the collection of objects. In the shipping industry, for example, a collection of materials may be placed on a pallet to secure such articles together during the shipping process. A collection of boxes placed on a pallet can be shipped as a single cohesive unit when bound together through wrapping with stretch wrap. Other applications of stretch wrap are known such as wrapping agricultural products or simply binding together a collection of items.

Although such usages for stretch wrap are well known and documented, the amount of stretch wrap used in any given application can be extensive. For example, for an industrial supplier that ships large numbers of pallets of materials out on a consistent basis, a large inventory of stretch wrap must be maintained to facilitate the regular shipment of such products. For example, a large amount of stretch film may be necessary to wrap a given pallet of materials. Typically, during application, a tension is applied to the stretch film as it is applied to the objects being wrapped. This tension stretches the film to facilitate a secure binding of the wrapped objects together, and this tension process also both strengthens the stretch film and allows for the use of less film. In typical approaches, the stretch creates a lengthening of the stretch wrap, but also creates significant narrowing of the stretch wrap in the direction not under tension. The narrowing causes less coverage of the object being wrapped and eliminating much of the efficiency gained in stretching the stretch wrap. One known device includes an idler roller that engages and rotates with the stretch wrap as it is pulled from its roll. The idler roller facilitates stretching of the wrap along its length due to the tension on the film. The roller also generally maintains the film's flat shape as it engages the object around which it is being wrapped. Although this stretch is advantageous, some narrowing does occur and further stretch and strength is still desirable. Another known approach is to stretch the stretch wrap with tension in the long direction while holding the sides of the stretch wrap to reduce narrowing. Such an approach is largely done through complex and expensive machinery. Another common application for stretch film is the containment and shipment of agricultural products where these products need to be ventilated to avoid spoilage or for evaporation of water. Current applications use stretch film that has holes cut into the film to allow the film to breath. This process is either done in-line during the manufacturing of the stretch film with expensive equipment or done off line as a secondary operation using expensive equipment to wind, perforate and then rewind the film. Moreover, it is common to secure the wrapped objects to the pallet through use of one or more straps. Such straps are typically metal or plastic bands that wrap over the object and through the pallet's under body. The metal or plastic band has two ends that are pulled tight and clamped together to secure the load to the pallet. Such strapping is expensive and generally not reusable. In addition, it is time consuming as the user must move the strapping over to the package, tighten the strapping with tooling and then secure the strapping together using some type of mechanical device.

The containment strength of stretch film is typically horizontal (around the load) rather than vertical (top to bottom) of the load. Often companies uses both strapping and stretch film in combination to best secure a shipment. This combination provides the maximum amount of containment force.

SUMMARY

Generally speaking and pursuant to these various embodiments, a stretch film dispensing apparatus gathers the stretch film into a string or rope for use in securing an object to a pallet for shipping. The stretch film can be converted into a string or rope by passing it through one or more of a hook, funnel, apparatus, set of gears, or the like to effect stretching and/or twisting of the film into a string or rope. The properties of stretch film allow a user to pull it tight, but in the process the user is creating memory or resurrecting memory in the film. The more it is stretched the stronger the material gets before reaching the material's breaking point. This memory has a certain amount of elasticity and retention capability in it such that when stretched further during shipping the stretch film naturally retracts some, which is ideal for holding together loads that are moving and unlike typical string or rope that is rigid and does not have much give nor the ability to pull very tight when the user pulls on it to tighten it up around the package. The described approaches for making the string or rope from stretch film can be applied to regular, "pre-stretch," and other variations of stretch film, which are referred to collectively as "stretch film."

The stretch film is easy to tie off and then pulled through the knot like string or rope. Companies as a whole, however, are generally not willing to risk their products based on the knot tying ability of their employees. The stretch film properties allow it to be pulled through a clasp, making it easier to achieve additional tension around a load and secure the load in a more consistent basis. A clasp or clamping device that readily traps one end of the string and allows for tightening of the string while then a pulling a second end of the string through a second portion of the clasp or clamping device is ideal to secure a load. The second end of the string can be tied off or clamped on the second portion of the clasp or claiming device to secure the load. The design of the clasp and the stickiness of the stretch film allows the string to stay taught during the tying process and not slip. Furthermore, the design of the clasp allows the stretch film string to be easily loaded while it is still attached to the dispenser so that no material is wasted when the second end is cut after securing the load.

The increase in stretch and gathering into strings of the stretch wrap results in a strong material that can hold together large loads similar to prior art straps while using a lower cost material, i.e., stretch wrap. By mounting the dispensing device onto a mobile device, such as a cart, the device can be situated next to a pallet for ready application to a load. The described clamps or clasps provide a ready ability to tighten and secure the strings to the load more easily and consistently. For instance, the process of securing the load via the stretch string/rope is also faster than the use of strapping. The clamps or clasps can be manufactured using a low cost and disposable or recyclable material. These and other benefits may become clearer upon making a thorough review and study of the following detailed description.

BRIEF DESCRIPTION OF THE DRAWINGS

The above needs are at least partially met through provision of the stretch wrap dispenser described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
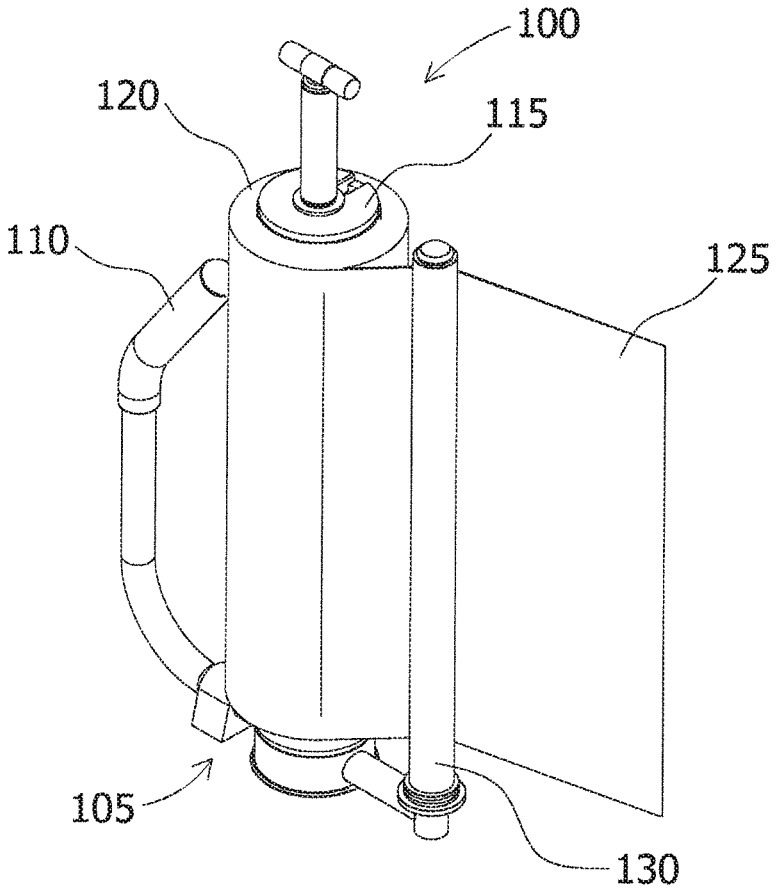
Fig. 1 Prior Art
FIG. 1 comprises a perspective view of a prior art stretch film dispenser.

Referring now to the drawings and, in particular to FIG. 1, a prior art stretch film dispenser 100 is illustrated. The stretch film dispenser includes a frame having a handle 105 extending from the frame, a rotatable support 115 is configured to engage and hold a roll 120 of stretch film and rotate with the roll 120 as the stretch film 125 is pulled and removed from the roll 120. The rotatable support or arm 115 is rotatably supported by the frame 105 using ball bearings or other rotatable supports as known in the art. The frame 105 also supports an elongated member 130 that extends next to the roll 120 and is disposed to engage the stretch film 125 as it dispenses from the roll 120. In use, the stretch film 125 engages an object to be wrapped and is kept in tension as the stretch film is dispensed from the roll 120 and applied to the object. The tension on the stretch film 125 stretches the stretch film 125 along its length as it is dispensed from the roll 120. The elongated member 130 facilitates stretching of the stretch wrap 125 as it engages the stretch wrap 125 during dispensing.

Figure 2:
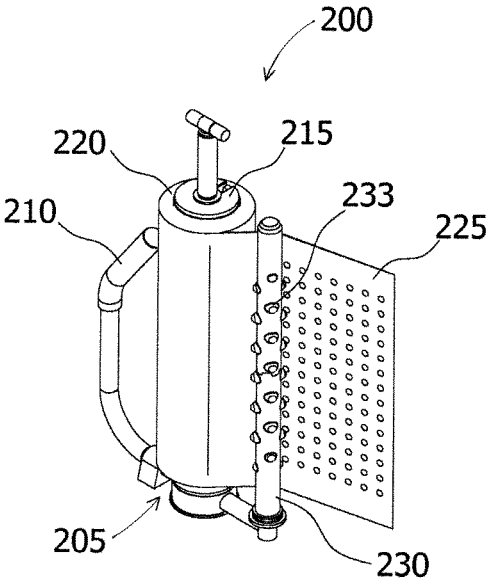
FIG. 2 comprises a perspective view of an example stretch film dispenser as configured in accordance with various embodiments of the invention.

FIG. 2 illustrates an example stretch film dispensing apparatus 200 for applying a stretch film to an object. The stretch film dispensing apparatus 200 includes a support frame 205, including an extension handle 210 that facilitates manual application of stretch film to an object. The frame 205 can be made of any suitable material such as a metal such as steel or plastic having sufficient strength to support the various aspects of the stretch film dispenser 200 against the forces experienced during stretch film application. One of skill in the art will recognize that the teachings of this disclosure are not limited to hand application of stretch film and may be applied to mechanical or automatic application of stretch wrap or film to objects. A support 215 is configured to support a roll 220 of stretch film and dispense the stretch film in response to tension on the stretch film 225. The support 215 may be a rotatable arm or an elongated element designed to engage a hollow center of a stretch film roll, gripping members designed to engage either end of a stretch film roll, or other design suitable to support a roll of stretch film for dispensing.

The frame 205 also supports at least one member 230 having protrusions 233 configured to engage the stretch film 225 after the stretch film 225 extends from the roll 220 and before the stretch film 225 contacts the object. The protrusions 233 are configured to distort or variably stretch the stretch film 225 along a length of the stretch film 225 engaging the at least one member 230. In the example of FIG. 2, the at least one member is disposed generally parallel to the roll 220 and is an elongated rotatable member that is cylindrical with the protrusions extending out from a radius of the cylinder. The frame 205 in the illustrated example supports the member 230 in a rotatable fashion using roller bearings or other suitable means known in the art such that the member 230 rotates as the stretch film 225 is dispensed and rolls over the member 230. In this way, the protrusions 233 engage and release the stretch film 225 to deform it as the member 230 rolls with the dispensed stretch film 225. The member 230 can be formed out of any of a variety of materials having sufficient stiffness to deform the stretch film. For example, the member 230 can be a pre-formed plastic piece to reduce adhesion between the stretch wrap and the member 230. Also, the member 230 can have any of a variety of cross sectional shapes or be irregularly shaped including optionally protrusions that intentionally pierce the film to give it extra elongation or some type of ventilation. The protrusions also can have a variety of forms as discussed below. These protrusions could also be applied off line during the manufacturing of the stretch film.

Figure 4:
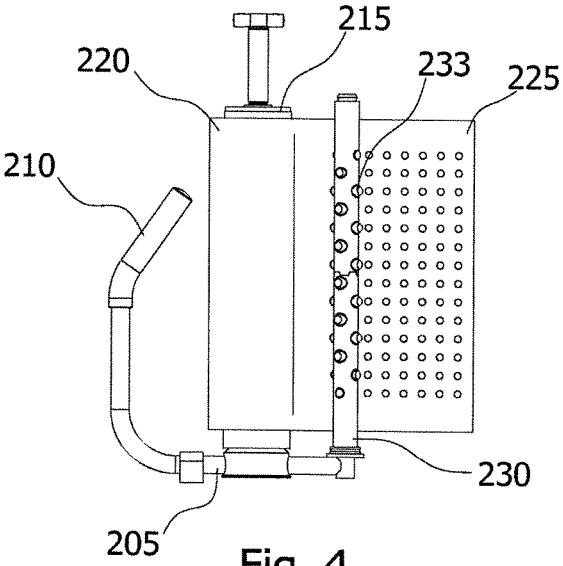
FIG. 4 comprises a side view of the example stretch film dispenser of FIG. 2.
Figure 5:
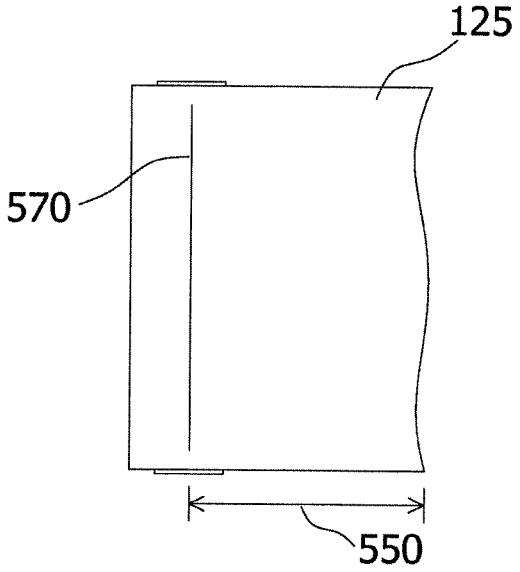
FIG. 5 comprises a side view of stretch film pulled from a roll of stretch film using a stretch film dispenser similar to that of FIG. 1.
Figure 6:
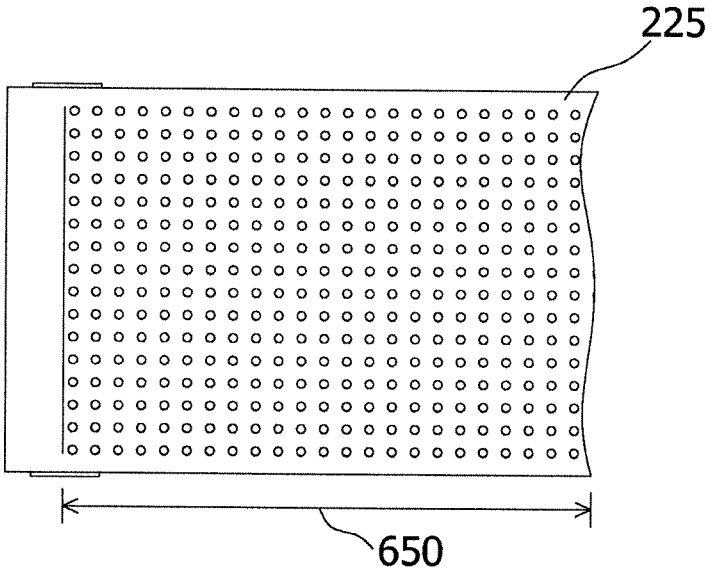
FIG. 6 comprises a side view of stretch film dispensed from a roll of stretch film using a stretch film dispenser configured in accordance with various embodiments of the invention.
Figure 7:
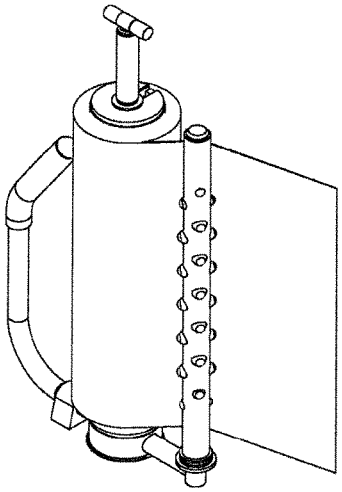
FIG. 7 comprises a perspective view of another example stretch film dispenser as configured in accordance with various embodiments of the invention.
Figure 9:
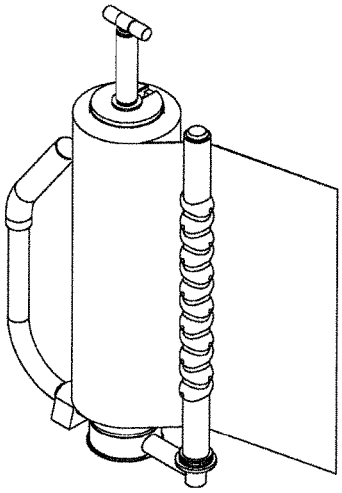
FIG. 9 comprises a perspective view of another example stretch film dispenser as configured in accordance with various embodiments of the invention.
Figure 8:
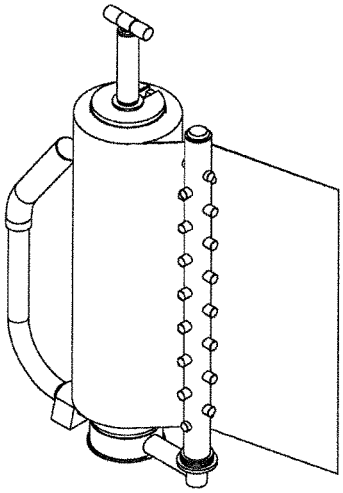
FIG. 8 comprises a perspective view of another example stretch film dispenser as configured in accordance with various embodiments of the invention.
Figure 10:
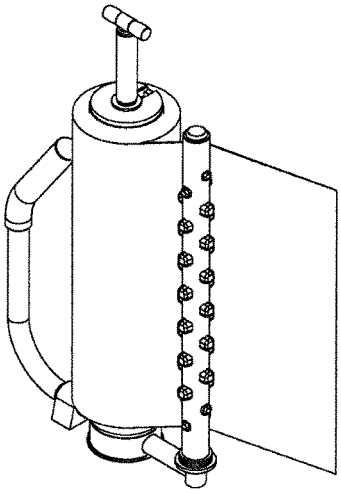
FIG. 10 comprises a perspective view of another example stretch film dispenser as configured in accordance with various embodiments of the invention.

In operation, the dispensing apparatus 200 performs a method for applying a stretch film to an object including engaging the stretch film 225 being dispensed from the dispenser 200 with the at least one member 230 having protrusions 233 to variably stretch the stretch film 225 along a length of the stretch film 225 engaging the at least one member 230. Maintaining tension on the stretch film 225 during engagement with the at least one member 230 effects additional stretch on the stretch film 225 before application to an object. For example, as shown in FIGS. 5 and 6, stretch film 125 dispensed from a stretch film dispenser such as that illustrated in FIG. 1 will have a stretched length 550 of a given amount with the length being defined from a point of engagement 570 with the rotatable member 130 to an end portion of the stretch film 125. FIG. 6 illustrates a same amount of stretch film 225 dispensed from a dispenser like that illustrated in FIGS. 2-4 having a tension similar to that of the stretch film dispensed as illustrated in FIG. 5. The stretch of the stretch film 225 illustrated in FIG. 3 at 650, illustrates that the additional stretching of the stretch film through engagement with the protrusions 233 in combination with the tension applied during application allows the stretch film 225 to stretch out up to at least 15% more as compared to using a prior stretch film application device.

Figure 3:
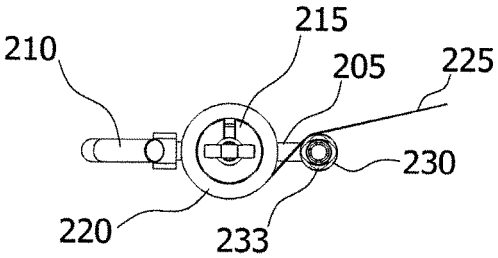
FIG. 3 comprises a top view of the example stretch film dispenser of FIG. 2.

Generally speaking, when the protrusions 233 engage the stretch film 225, the protrusions locally stretch a portion of the stretch film 225 transverse to the plane of the stretch film 225. In contrast to the stretching of the film that is entirely in the plane of the stretch film 225 such as when the stretch film is applied using a dispenser like that of FIG. 1, stretch film being applied using a device such as that of FIGS. 2-4 is additionally stretched in the transverse direction. This transverse action bi-axially orients the film to improve its strength and increasing its area of coverage. The extra stretch in the transverse direction in turn produces an additional stretch in the length of the stretch film 225 when a tension is provided laterally on the stretch film 225.

FIGS. 7-10 illustrate additional examples of the types of protrusions and/or patterns of protrusions that can be used to provide a transverse stretching of the stretch film as it is being dispensed from a roll. As illustrated, the protrusions can come in any of a variety of shapes and sizes designed to effect a stretch and/or piercings in the stretch film transverse to the plane of the stretch film. The examples of FIGS. 7-10 can be modified in a variety of ways to effect such stretching. For example, the protrusions may come in regular or irregular patterns.

Figure 12:
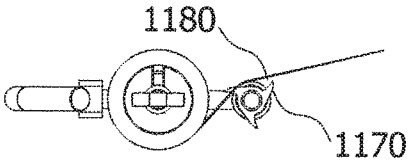
FIG. 12 comprises a top view of the example stretch film dispenser of FIG. 11.
Figure 11:
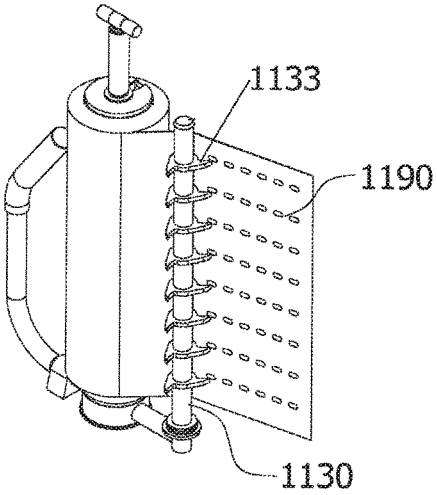
FIG. 11 comprises a perspective view of an example stretch film dispenser that can pierce a film as configured in accordance with various embodiments of the invention.
Figure 13:
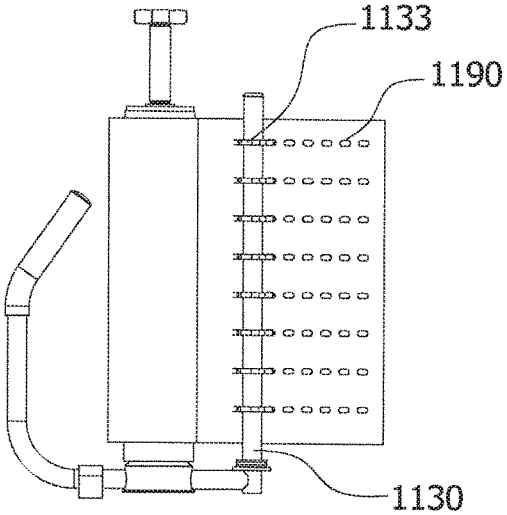
FIG. 13 comprises a side view of the example stretch film dispenser of FIG. 11.

FIGS. 11-13 illustrate another example type of protrusion array designed to pierce the stretch film as it is dispensed from a roll. In this example, the protrusion 1133 includes a leading, curved edge 1170 that initially engages and stretches the film as it engages the member 1130. As the film progresses past the rotating member 1130, the protrusion 1133 rotates further into the film until a pointed end 1180 of the protrusion 1133 pokes through the tensioned film to create a piercing 1190. So configured, an array of piercings 1190 are created in the film while at the same time the film is stretched as described above. In this approach, the benefits of stretching the film are achieved together with providing a way to allow air circulation through the film after it is applied to an object. One skilled in the art will recognize that other particular shapes of protrusions can be used to pierce the film. Moreover, combinations of different types of protrusions can be used on a single member for engaging the film. For instance, one set of protrusions may be designed to pierce the film, and a second set of protrusions can be designed to only stretch the film so that the processed film includes both stretched portions and pierced portions.

Figure 16:
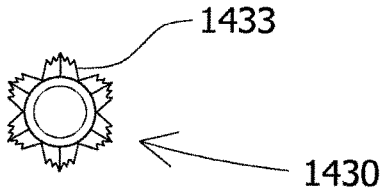
FIG. 16 comprises a top view of the example member of FIG. 14.
Figure 15:
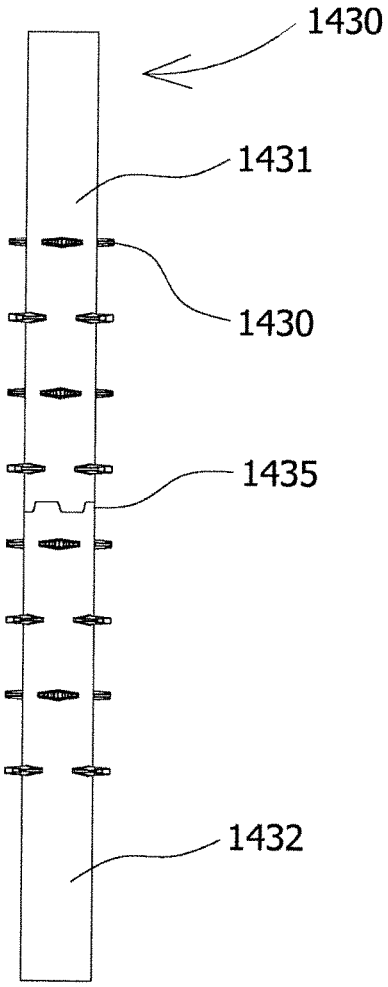
FIG. 15 comprises a side view of the example member of FIG. 14.
Figure 14:
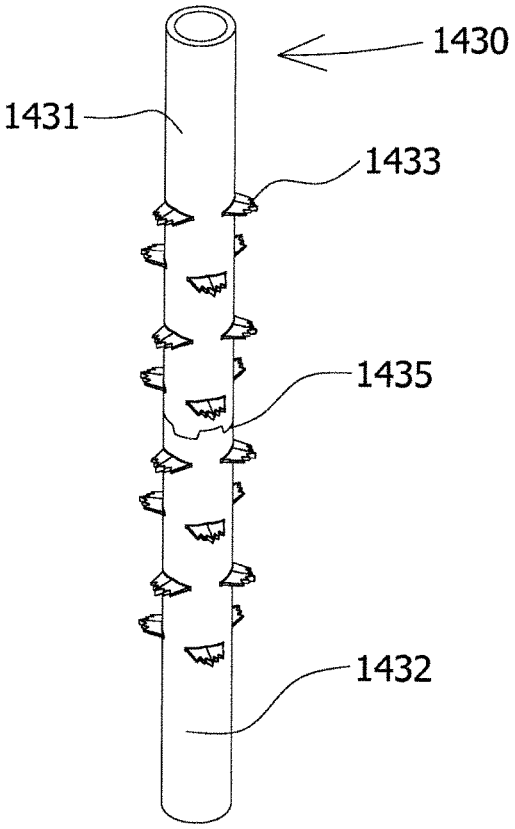
FIG. 14 comprises a perspective view of an example rotatable member with projections as configured in accordance with various embodiments of the invention.

For example, FIGS. 14-16 illustrate another example type of protrusion designed to pierce the stretch film. In this example, the rotatable member 1430 includes two pieces 1431 and 1432 mated together along a seam 1435. The protrusions 1433 include a jagged edge designed to pierce the stretch film when the film engages the protrusions 1433. Such a design does not stretch the film as much as other protrusion designs before piercing the film. Many such designs are possible for the protrusions.

Figure 18:
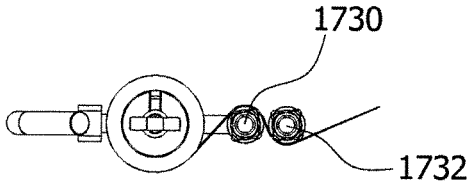
FIG. 18 comprises a top view of the example stretch film dispenser of FIG. 17.
Figure 17:
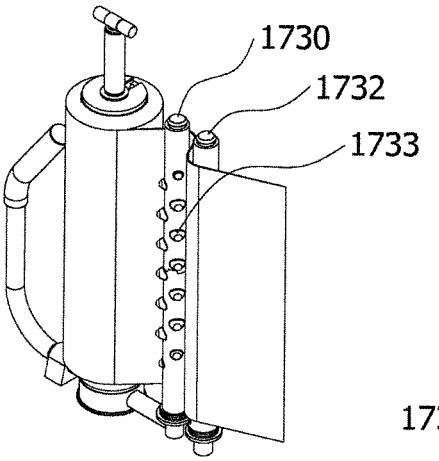
FIG. 17 comprises a perspective view of an example stretch film dispenser having two members engaging the film as configured in accordance with various embodiments of the invention.
Figure 19:
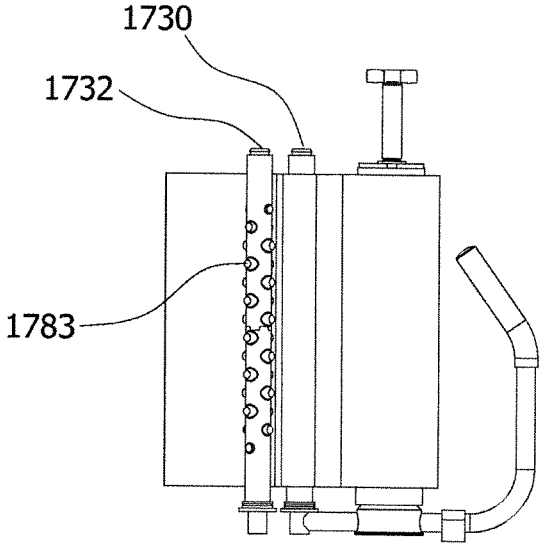
FIG. 19 comprises a side view of the example stretch film dispenser of FIG. 17.

Moreover, additional members including protrusions may be used to engage the stretch film as it is dispensed from the dispenser. For example, a second roller having protrusions may be placed along the stretch film's path extending from the dispenser before engaging the object. FIGS. 17-19 illustrate one such example approach to having two rollers or members engaging the film. The first roller 1730 includes protrusions 1733 to engage the film as the film separates off of its roll to stretch or pierce the film as described above. The second roller 1732 is disposed in the film's path to provide additional stretch in the film's length and to stabilize the film's width to provide additional protection against necking of the film. The second roller may or may not include protrusions. In one such approach shown in FIG. 19, the second roller 1732 includes protrusions 1783 designed to engage the stretch wrap in a pattern to largely not overlap with portions of the stretch film that engage protrusions of a first member engaging the stretch film. Other combinations of protrusions between two or more rollers designed to engage the stretch film are possible.

Figure 20:
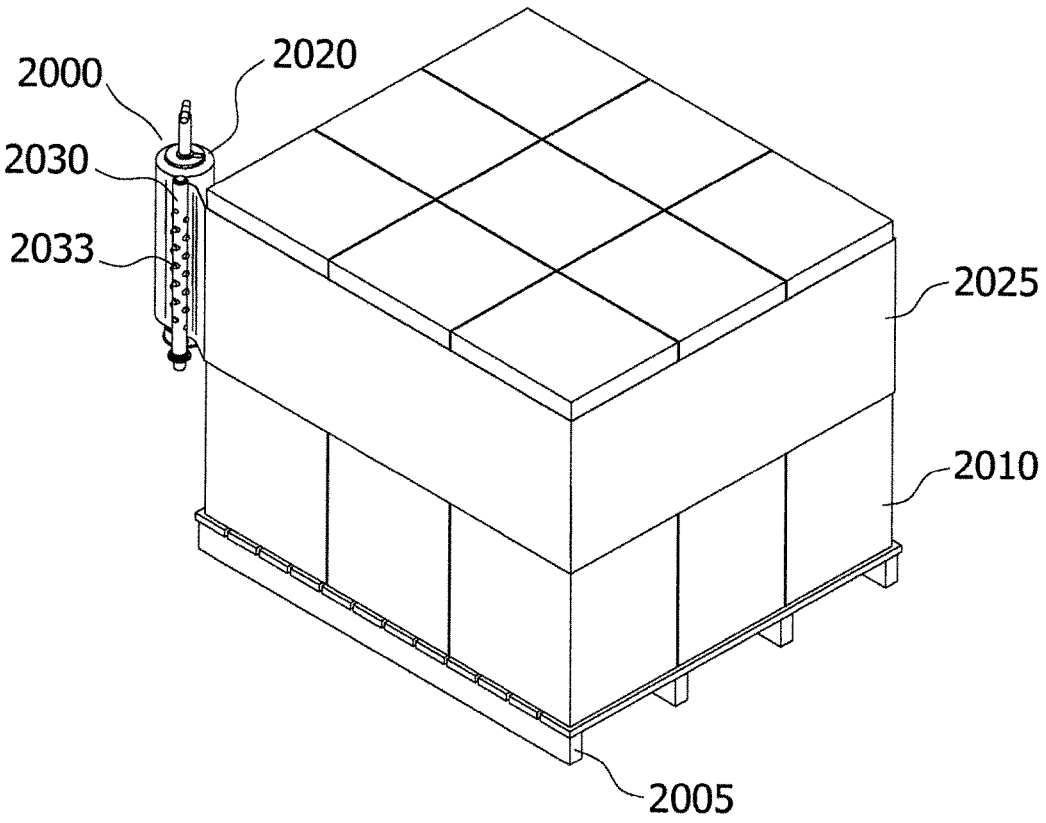
FIG. 20 comprises a perspective view of a pallet with objects being wrapped with stretch wrap using an example stretch wrap dispenser configured in accordance with various embodiments of the invention.

An example application for dispensing stretch film from a stretch film dispenser such as accordingly to the teachings of this disclosure is shown in FIG. 20. The pallet 2005 supports a plurality of boxes 2010 for shipping. After an end of the stretch film is secured to the boxes 2010, a person holds and pulls the frame of the dispenser 2000 along the surface of the boxes 2010, effectively pulling the film 2025 from the roll 2020 over the idler roller 2030. The dispenser 2000 continues to pull the stretch film 2025 around the boxes 2010 to wrap and bind the boxes 2010 together for stability during shipping. The dispenser 2000 includes an idler roller 2030 having protrusions 2033 configured to engage the stretch film 2025 and stretch it along its length through application of tension and in a direction transverse to the length of the stretch film 2025 through engagement of the protrusions 2033 on the stretch film 2025. So configured, the stretch film 2025 exhibits an improved stretch and can cover more of the boxes using less stretch film 2025 from the roll 2020. Thus, less stretch film 2025 is needed to securely wrap the boxes 2010 on the pallet 2005.

Figure 21:
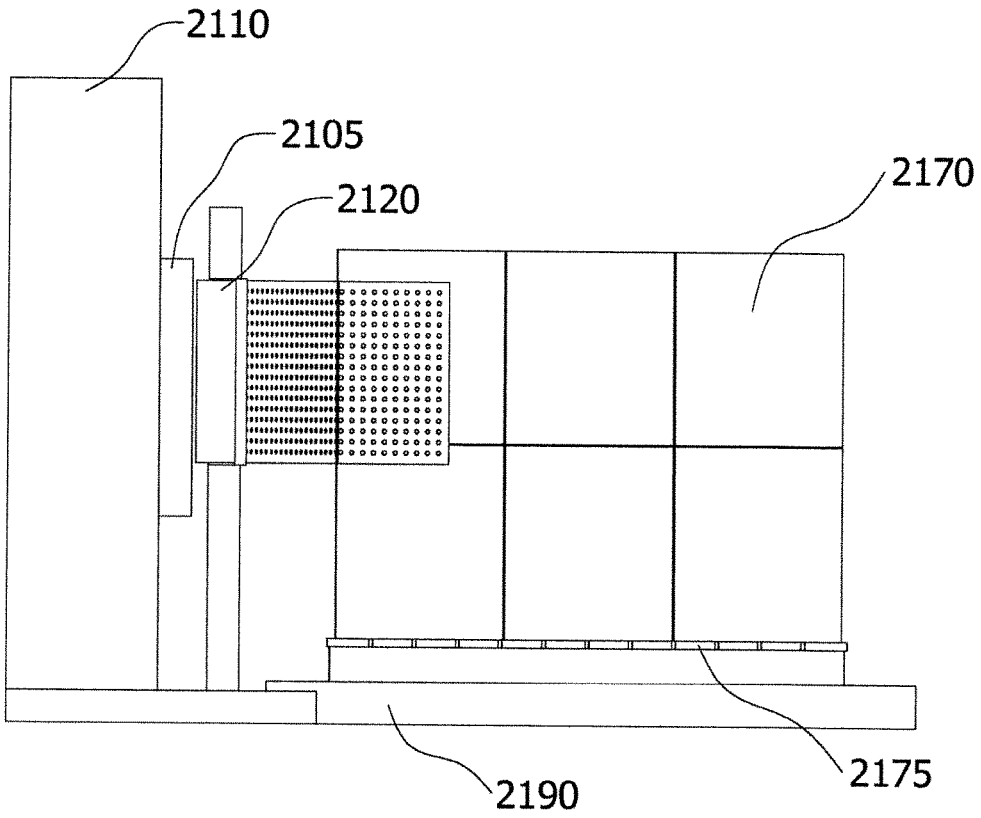
FIG. 21 comprises a perspective view of a pallet with objects being wrapped with stretch wrap using an example stretch wrap dispenser configured in accordance with various embodiments of the invention.

Another application is illustrated in FIG. 21 where the roll 2120 of stretch film is mounted to a frame 2105 supported by a larger apparatus 2110. In this case the larger apparatus 2110 is configured to move the roll 2120 up and down relative to the boxes 2170 stacked on a pallet 2175. The apparatus 2110 cooperates with a rotation mechanism 2190 configured to rotate the pallet 2175. After an end of the stretch film is secured to the boxes 2170, the rotation of the pallet 2175 pulls the stretch film from the roll 2120. A roller with protrusions is disposed next to the roll 2120 to engage the tensioned stretch film as it leaves the roll 2120 and before it engages the boxes 2170. Such an auto-wrapping device is known in the art and needs no further explanation. The apparatus 2110 can be modified to include a mechanism to modify the tension on the stretch film as it is applied the boxes 2170.

Figure 22:
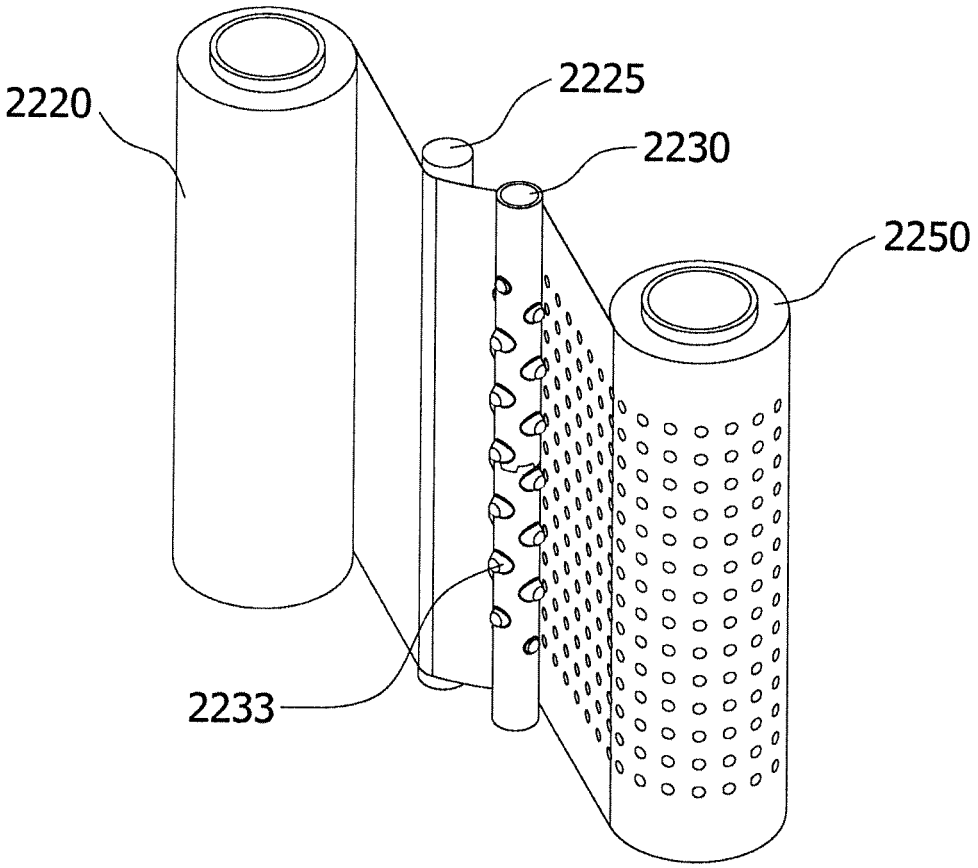
FIG. 22 comprises a perspective view of a partial apparatus for pre-stretching and re-rolling a stretch film in accordance with various embodiments of the invention.

Another example application of this subject matter is in applying the protrusions to bi-axially stretch the stretch film during the stretch film's preparation and prior to its being rolled onto a roll for dispensing. In one example of this approach, one or more members like that described above can be disposed to engage stretch film just before the stretch film is rolled up. One such example is illustrated in FIG. 22. In the illustrated example, stretch film is unrolled from a first roll 2220 over a first roller 2225 that stretches the film along its length. A second roller 2230 then engages the film with protrusions 2233 to stretch the film locally and transverse to the plane of the stretch film. Optionally, the stretch film can be pierced in addition to or instead of being stretched by the protrusions. The stretched film is then re-rolled onto a second roll 2250 for storage for later use. Mechanisms can be built to support the rolls 2220 and 2250 and rotate them to effect the stretch film's engagement of the rollers 2225 and 2230. The roller 2225 and 2230 may have any combination of protrusions or not, depending on the type of stretch or piercing desired for a given pre-stretched film. Such pre-stretched stretch film can then be applied using a prior applicator such as that of FIG. 1 while maintaining much of the advantageous described above.

Figure 23:
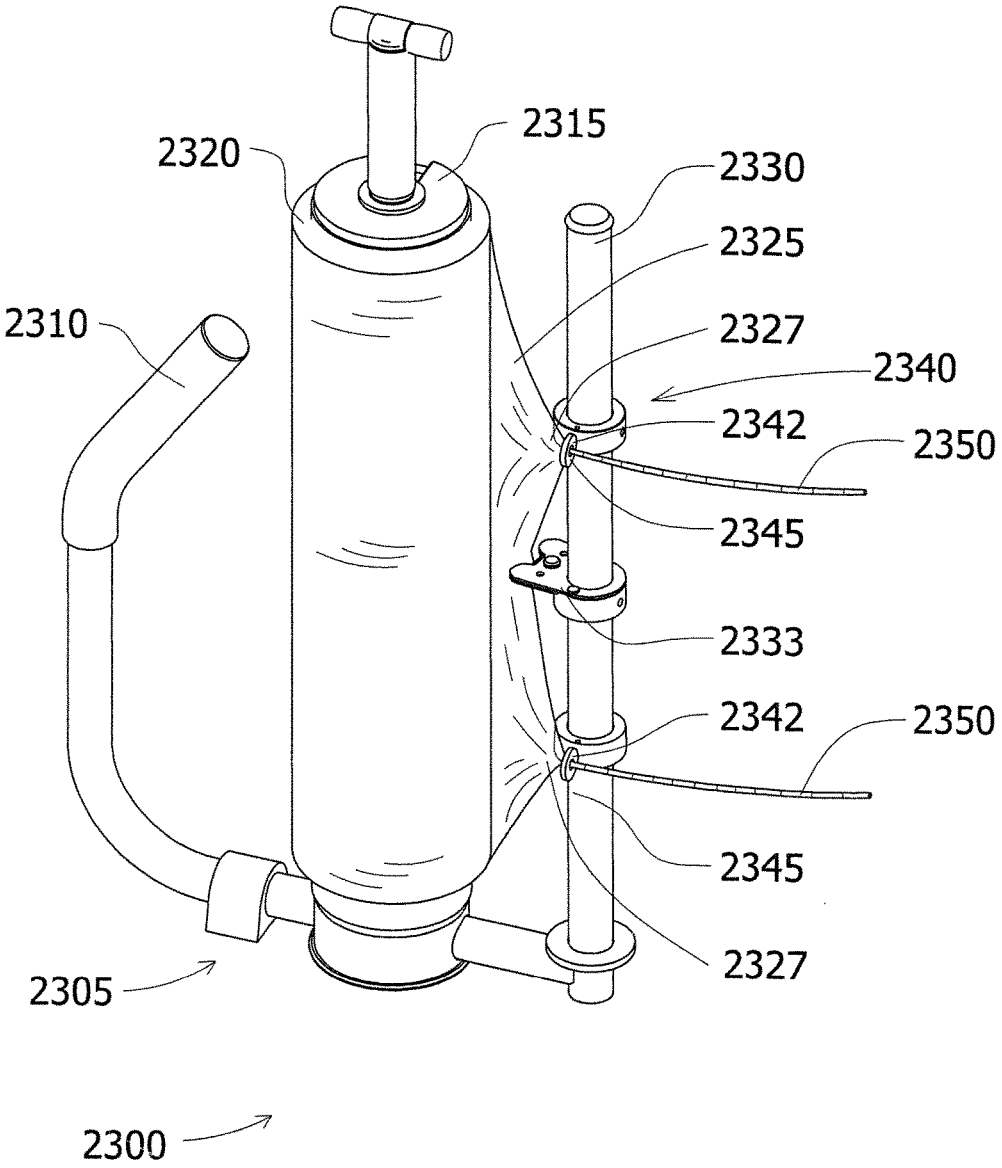
FIG. 23 comprises a perspective view of an example stretch film dispenser having a cutting device and gathering devices forming the film into strings as configured in accordance with various embodiments of the invention.
Figure 24:
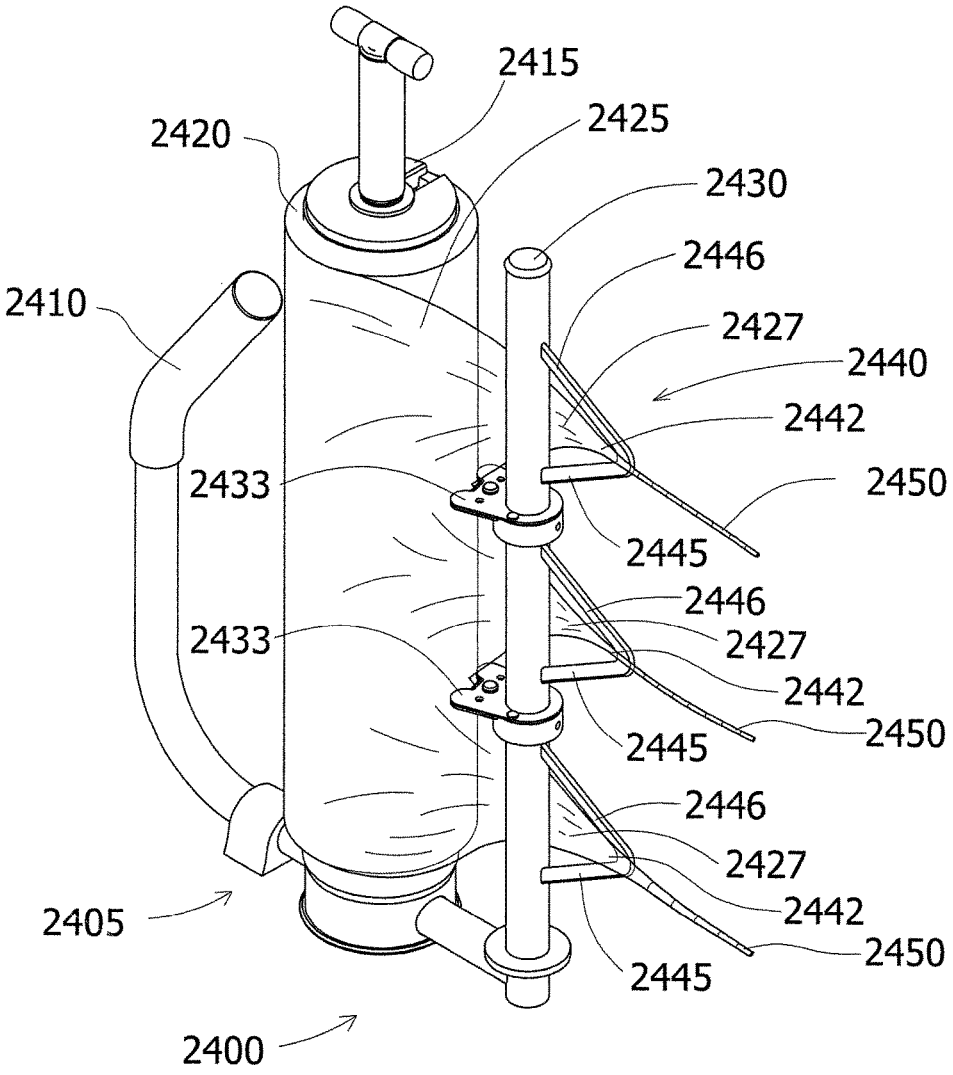
FIG. 24 comprises a perspective view of an example stretch film dispenser having two cutting devices and three gathering devices forming the film into strings as configured in accordance with various embodiments of the invention.
Figure 25:
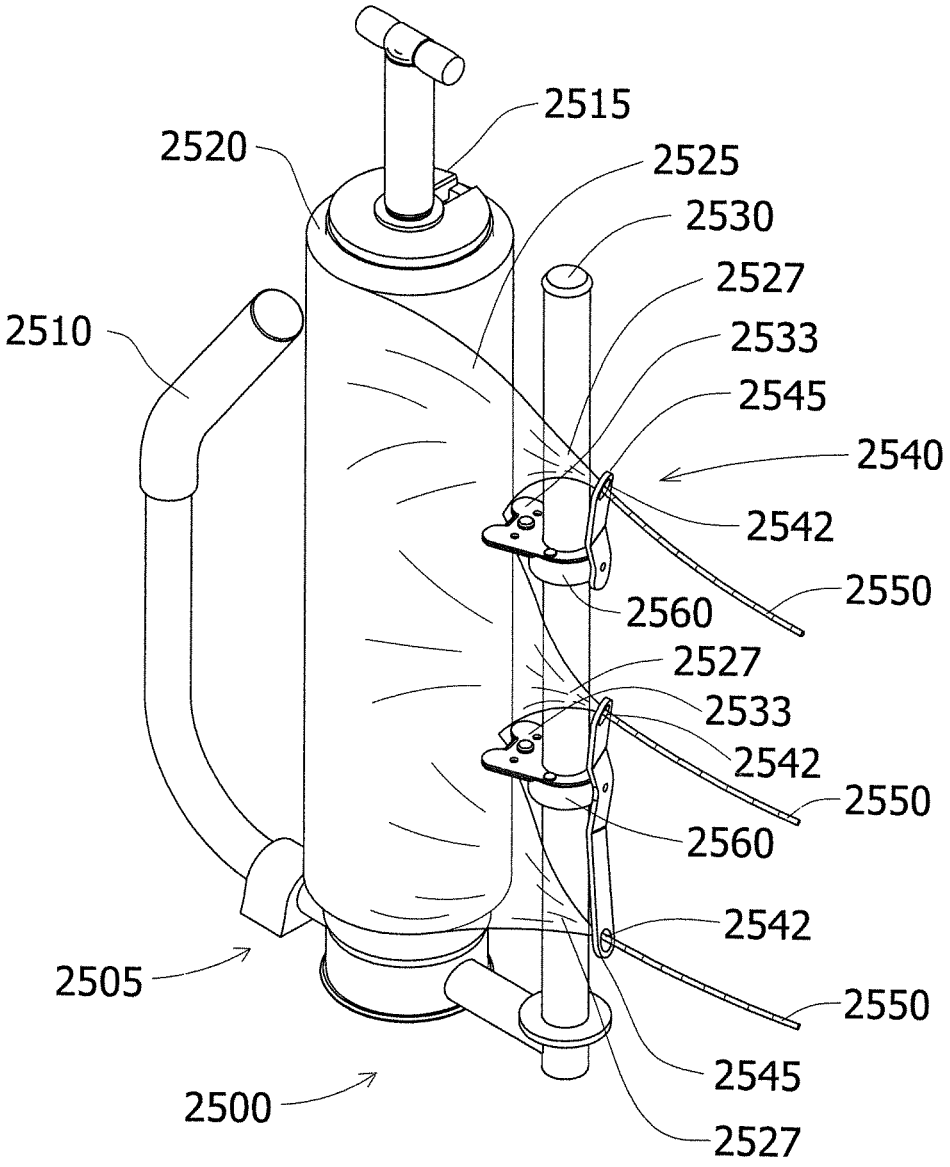
FIG. 25 comprises a perspective view of another example stretch film dispenser having two cutting devices and three gathering devices forming the film into strings as configured in accordance with various embodiments of the invention.

In another approach, instead of merely stretching or piercing the stretch wrap, the stretch wrap is cut into strips, which are stretched and gathered into strings that are used to wrap and secure the object. Three such examples are illustrated in FIGS. 23, 24, and 25. In each, an apparatus 2300, 2400, 2500 for applying a stretch film to an object includes a support frame 2305, 2405, 2505 including an extension handle 2310, 2410, 2510 that facilitates manual application of stretch film to an object. The frame 2305, 2405, 2510 can be made of any suitable material such as a metal such as steel or plastic having sufficient strength to support the various aspects of the stretch film dispenser 2300, 2400, 2500 against the forces experienced during stretch film application. One of skill in the art will recognize that the teachings of this disclosure are not limited to hand application of stretch film and may be applied to mechanical or automatic application (in-line application) of stretch wrap or film to objects, such as that illustrated in FIG. 21. A support 2315, 2415, 2515 is configured to support a roll 2320, 2420, 2520 of stretch film 2325, 2425, 2525 and dispense the stretch film 2325, 2425, 2525 in response to tension on the stretch film 2325, 2425, 2525. The support 2315, 2415, 2515 may be a rotatable arm or an elongated element designed to engage a hollow center of a stretch film roll, gripping members designed to engage either end of a stretch film roll, or other design suitable to support a roll of stretch film for dispensing.

A support member 2330, 2430, 2530 extending approximately parallel (being sufficiently in line to facilitate the cutting and gathering operations along the width of the stretch wrap) to the support 2315, 2415, 2515 to be along a path between the stretch film 2325, 2425, 2525 dispensed from the stretch roll 2320, 2420, 2520 and the object. By one approach, the extension handle 2310, 2410, 2510 is disposed opposite of the support member 2330, 2430, 2530 to facilitate manual operation and control of the stretch wrap as it is applied to the object. At least one cutting member 2333, 2433, 2533 is supported by the support member 2330, 2430, 2530 and relative to the stretch film 2325, 2425, 2525 to cut the stretch film 2325, 2425, 2525 into at least two strips 2327, 2427, 2527 upon removal from the roll 2320, 2420, 2520. At least two gathering devices 2340, 2440, 2540 are disposed to stretch and gather individual ones of the at least two strips 2327, 2427, 2527 of stretch film 2325, 2425, 2525 into strings 2350, 2450, 2550 configured to wrap around the object. The gathering devices engage, gather, and provide and maintain tension on the stretch film 2325, 2425, 2525 after the stretch film 2325, 2425, 2525 engages the gathering devices to effect additional stretch and gathering of the stretch film 2325, 2425, 2525 into the elongated strings 2350, 2450, 2550 that are applied to the object.

So configured, the dispenser is able to cut, stretch, and gather the stretch film into stretched strings having a significant tensile strength while also being stretched out enough to effect a savings in the amount of stretch wrap used to wrap and secure a particular object. Such approaches can be advantageous for certain loads that need some air circulation and thus cannot withstand being fully sealed by the stretch film. FIGS. 23, 24, and 25 illustrate three particular examples of such dispensers although details of these examples may be modified while still being within this inventive concept.

In the example of FIG. 23, individual ones of the at least two gathering devices 2340 define apertures 2342 disposed to direct the strips 2327 away from the stretch roll 2320 and toward the object. The gathering devices 2340 may be rigid rings or washers 2345 secured to the support member 2330. The inner round (although other shapes are possible) apertures 2342 of the rings or washers 2345 engage, gather, and provide and maintain tension on the stretch film 2325 as the strips 2327 pass through the apertures 2342 while moving toward the object to effect additional stretch and gathering of the stretch film 2325 into the elongated strings 2350 that are applied to the object. The inner apertures 2342 may comprise or be coated in a variety of materials to effect different stretching forces on engaging the stretch wrap. In other approaches, the gathering devices may be slots defined to selectively engage and gather the stretch film 2325 into strings or ropes, with the slots allowing the stretch film 2325 to be released from the gathering devices to stop the gathering of the material into strings or ropes.

In the example of FIG. 24, individual ones of the at least two gathering devices 2440 include two members 2445 and 2446 supported by the support member 2430 and intersecting in a direction away from the support 2405 configured to support the roll 2420. The two members 2445 and 2446 and support member 2430 define an aperture 2442 disposed to direct one of the strips 2427 away from the roll 2420 and toward the object. The two members 2445 and 2446 may be two distinct members that are mechanically connected together to define the aperture 2442 with the support 2430 or, in another approach, the two members 2445 and 2446 may be separate legs of a single angled member that is mounted to the support 2430 to define the aperture 2442.

In the example of FIG. 25, individual ones of the at least one of the gathering members 2550 comprises a rigid member 2545 mounted to the support member 2530. The rigid member 2545 has a distal end extending away from the support 2530 and defining an aperture 2542. The aperture 2542 is configured to receive, gather, and stretch one of the strips 2527 into one of the strings 2550 as the strips 2527 pass through the apertures 2542 while moving toward the object. In one approach, the dispenser 2550 also includes a mount 2560 configured to mount to the support member 2530 and to support at least one of the cutting members 2533 and at least one of the rigid members 2545. In this example the rigid members 2545 made comprise any of a variety of materials having different flexibilities such that the rigid members 2545 may have some flex during the stretching and dispensing of the stretch film, but not so much flex that the rigid members 2545 are unable to direct the strings 2550 toward the object being secured. As with the above examples, the inner aperture 2542 may comprise or be coated in a variety of materials to effect different stretching forces on engaging the stretch wrap as it moves through the aperture 2542.

For instance, the surface of the gathering device frictionally grips the stretch film as it is gathered and pulled through the gathering device, which friction causes a tension in the material between the gathering device and whatever is pulling the material from the gathering device. In this manner, the stretch affected by that tension can be modified through particular design of the gathering device, both in its material and aperture size. For instance, the gathering device can be a metal such as stainless steel that naturally grips the stretch film and which device can have an aperture or engaging surface having a width of approximately a half inch. In various approaches, different gathering devices can be used in series to effect different stretches and gathering aspects to the stretch film.

In still another approach, the gathering devices can be mounted so as to be rotatable to allow a user to selectively engage the gathering devices mid-stream (during continuous dispensing of the stretch film) to apply un-gathered stretch film or gathered strings to a load.

Figure 26:
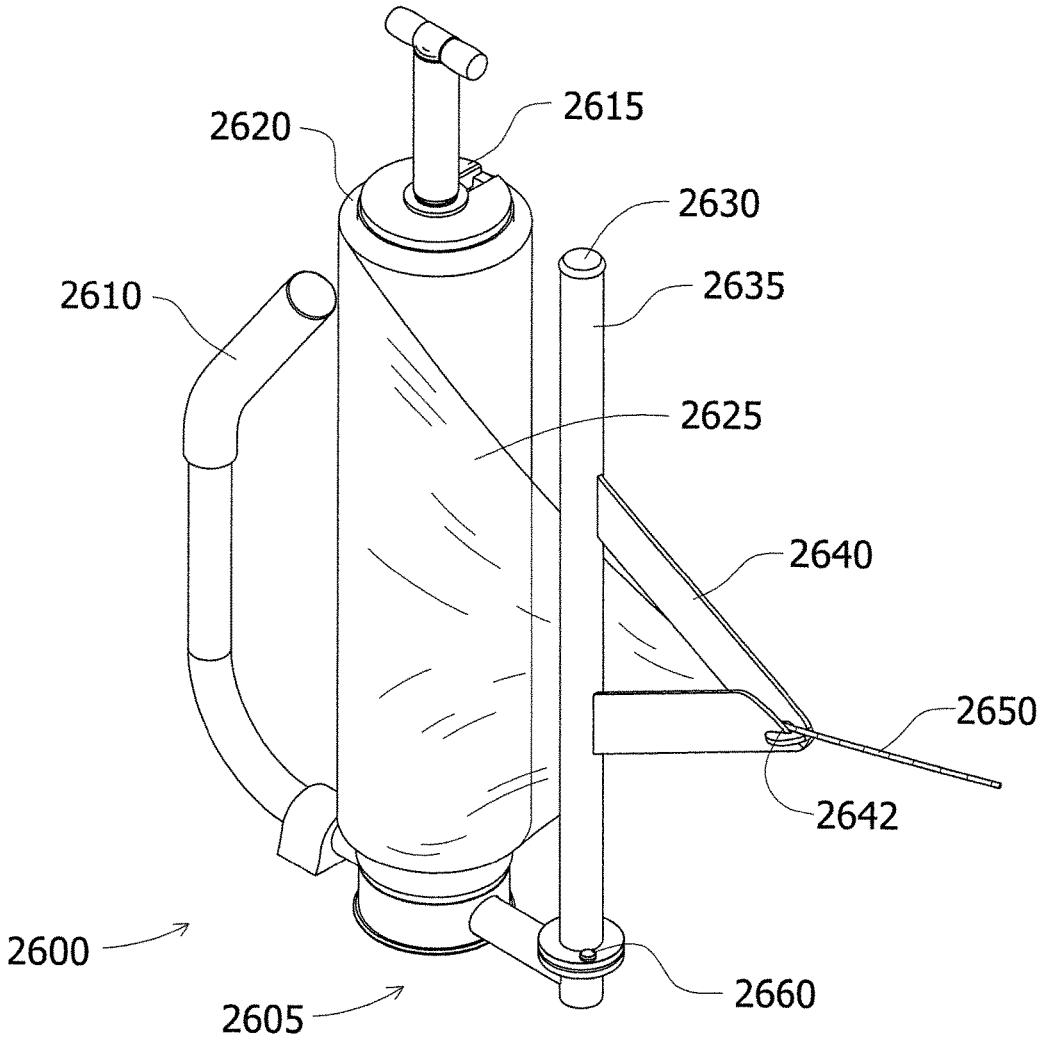
FIG. 26 comprises a perspective view of an example stretch film dispenser having a gathering device forming the film into a string or rope without cutting the film as configured in accordance with various embodiments of the invention.
Figure 27:
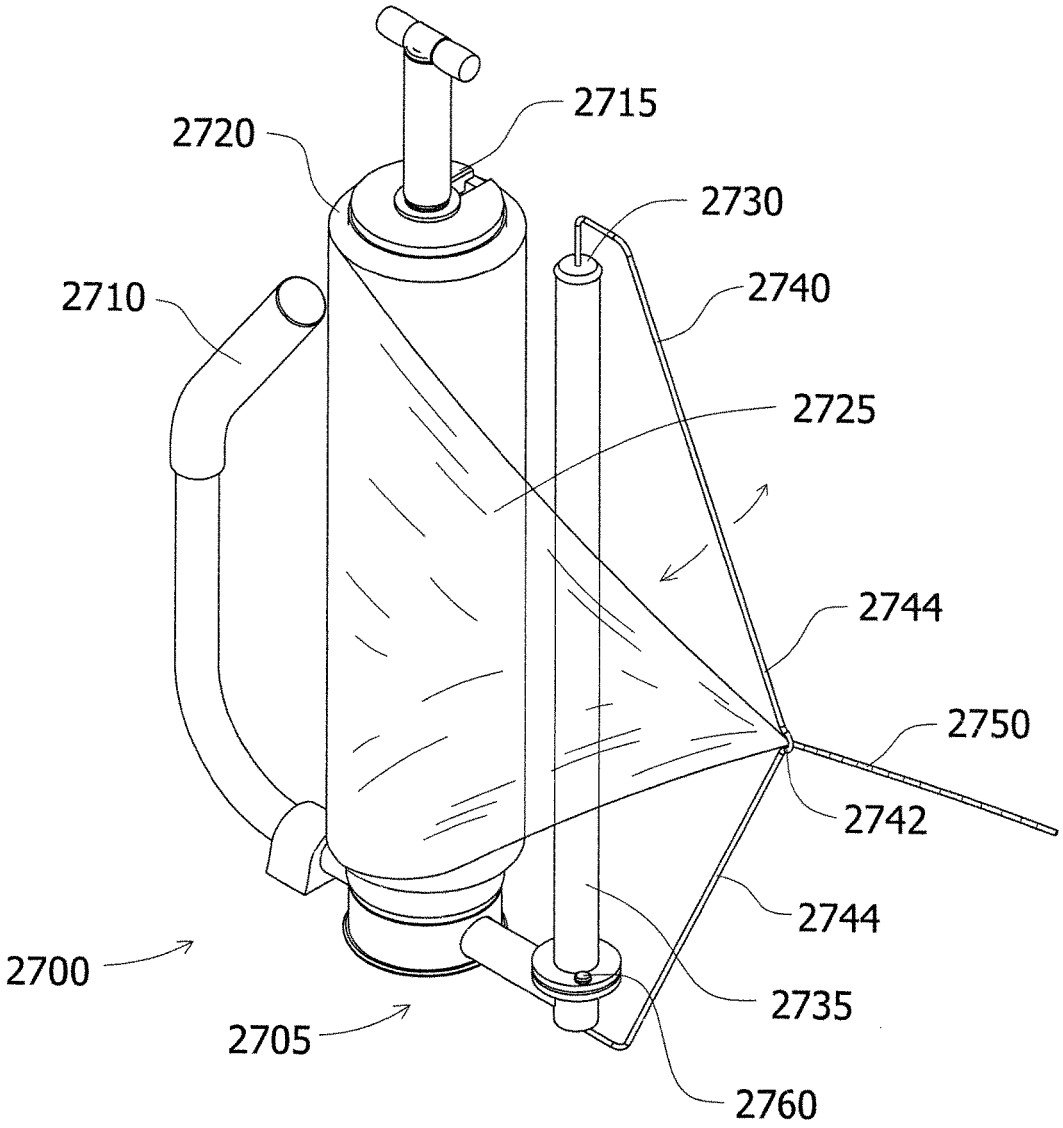
FIG. 27 comprises a perspective view of another example stretch film dispenser having a gathering device forming the film into a string or rope without cutting the film as configured in accordance with various embodiments of the invention.
Figure 28:
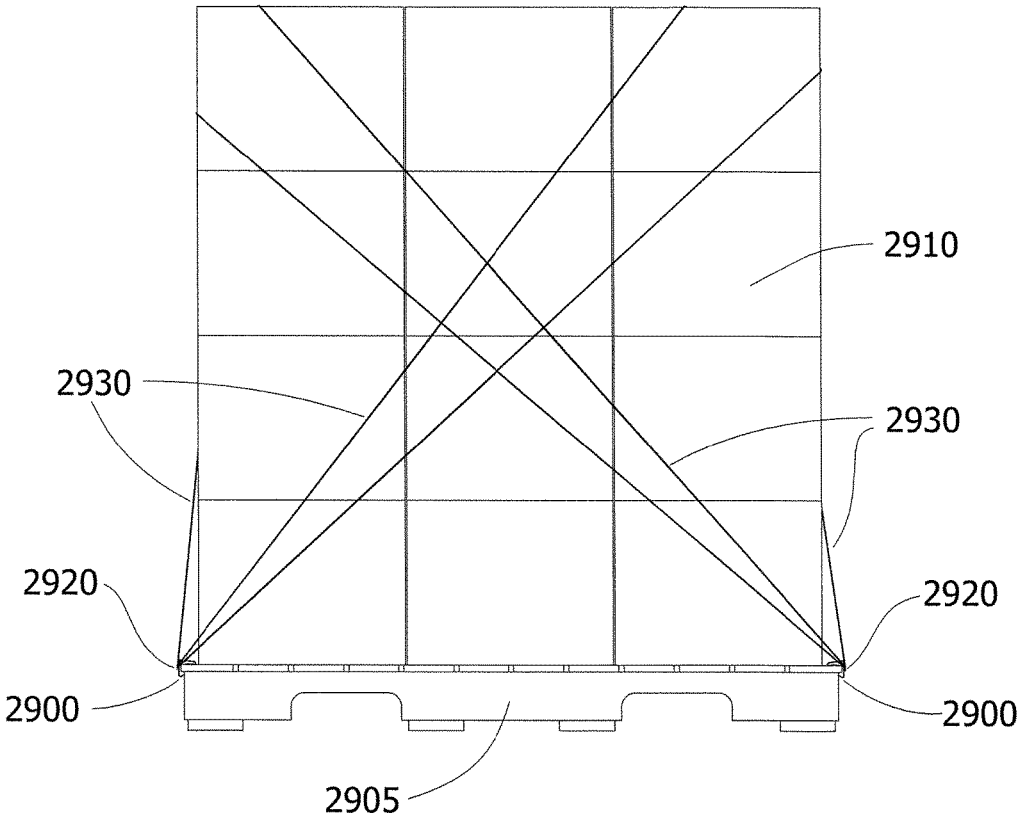
FIGS. 28 and 29 comprise side and perspective views of loads secured to pallets using rope or string material secured with an attachment apparatus as configured in accordance with various embodiments of the invention.

In yet another approach, instead of cutting the stretch wrap is cut into strips before gathering the strips into strings used to wrap and secure the object, the entirety of the stretch wrap can be stretched and gathered into one string or rope used to secure a load. Two such examples are illustrated in FIGS. 26 and 27. In both, an apparatus 2600, 2700 for applying a stretch film to an object includes a support frame 2605, 2705 including an extension handle 2610, 2710 that facilitates manual application of stretch film to an object. The frame 2605, 2705 can be made of any suitable material such as a metal such as steel or plastic having sufficient strength to support the various aspects of the stretch film dispenser 2600, 2700 against the forces experienced during stretch film application. One of skill in the art will recognize that the teachings of this disclosure are not limited to hand application of stretch film and may be applied to mechanical or automatic application (in-line application) of stretch wrap or film to objects, such as that illustrated in FIG. 21. A support 2615, 2715 is configured to support a roll 2620, 2720 of stretch film 2625, 2725 and dispense the stretch film 2625, 2725 in response to tension on the stretch film 2625, 2725. The support 2615, 2715 may be a rotatable arm or an elongated element designed to engage a hollow center of a stretch film roll, gripping members designed to engage either end of a stretch film roll, or other design suitable to support a roll of stretch film for dispensing.

A support member 2630, 2730 extending approximately parallel (being sufficiently in line to facilitate engaging the stretch wrap to stretch it and guide it to a gathering device) to the support 2615, 2715 to be along a path between the stretch film 2625, 2725 dispensed from the stretch roll 2620, 2720 and the object. By one approach, the extension handle 2610, 2710 is disposed opposite of the support member 2630, 2730 to facilitate manual operation and control of the stretch wrap as it is applied to the object. A rotatable member 2635, 2735 is supported by the support member 2630, 2730 and relative to the stretch film 2625, 2725 to engage and stretch the stretch film 2625, 2725 as it moves past the rotatable member 2625, 2725. A gathering device 2640, 2740 is disposed to stretch and gather the stretch film 2625, 2725 into a string or rope 2650, 2750 configured to wrap around the object. The gathering devices 2640, 2740 engage, gather, and provide and maintain tension on the stretch film 2625, 2725 after the stretch film 2625, 2725 engages the gathering devices to effect additional stretch and gathering of the stretch film 2625, 2725 into the elongated strings or ropes 2650, 2750 that are applied to the object. In various approaches, the gathering device 2640, 2740 may be mounted so as to be selectively or intermittently movable into engagement with the stretch film 2625, 2725. Thus, in one example, while dispensing stretch film 2625, 2725 from a roll from a manually operated dispenser for immediate application to an object, a gathering device 2640, 2740 intermittently engages the stretch film 2625, 2725 to dispense either the stretch film 2625, 2725 or a string 2650, 2750 created by the gathering device 2640, 2740 when the gathering device 2640, 2740 engages and gathers the stretch film 2625, 2725 during the application to the object.

So configured, the dispenser is able to stretch and gather the entire width of stretch film into one stretched string or rope having a significant tensile strength while also being stretched out enough to effect a savings in the amount of stretch wrap used to wrap and secure a particular object. Such approaches can be advantageous for certain loads that need some air circulation and thus cannot withstand being fully sealed by the stretch film. Moreover, rope gathered in this manner is more available to be un-gathered back into a flat stretch film for further or reuse. Also, where the gathering device is configured to be movable, a person using such a dispenser is able to selectively apply the gathering device to change on the fly between applying stretched film or string(s), based on the application of the gathering device. FIGS. 26 and 27 illustrate two particular examples of such dispensers although details of these examples may be modified while still being within this inventive concept.

In the example of FIG. 26, the gathering device 2640 defines an aperture 2642 shaped to gather the edges of the stretch film 2625 as it pulls away from the stretch roll 2320 together into the rope 2650 directed toward the object. The gathering device 2640 in this example is rigidly mounted on the rotatable member 2635 to rotate with that member 2635. The rotatable member 2635 can be locked in place to prevent location by a locking mechanism 2660. The locking mechanism 2660 can be any mechanism suitable to prevent rotation of the rotatable member 2635 in view of the loads created during a stretch wrap dispensing and roping operation. Examples include a gear lock, pin, and the like. Using the locking mechanism 2660, the rotatable member 2635 and the gathering device 2640 can be positioned in any angular position relative to the stretch film roll 2620 to facilitate the dispensing and gathering operation for a given application. For instance, the gathering device 2640 and the rotatable member 2635 can be locked in a position such that stretch film 2625 is dispensed without engaging the gathering device 2640 such that the stretch film 2625 is applied to the object without gathering. In another approach, they may be locked in a position to facilitate engagement of the stretch film 2625 by the gathering device 2640. In such a position, the gathering device 2640 engage, gather, and provide and maintain tension on the stretch film 2625 as the stretch film 2625 passes through the aperture 2642 while moving toward the object to effect additional stretch and gathering of the stretch film 2625 into the elongated string or rope 2650 that is applied to the object. The gathering device 2640 may comprise or be coated in a variety of materials to effect different stretching forces on engaging the stretch wrap 2625, such as steel or other material.

In the example of FIG. 27, the gathering device 2740 includes a rounded member extending out from the rotatable member 2735 so as to be rotatable independent from the rotatable member 2735 and the support 2730. For example, the gathering device 2740 here may be an extended thick wire bent into a shape to connect to be rotatably supported by the support 2730 and/or rotatable member 2735. The rounded nature of the gathering device 2740 can facilitate passage of the stretch film 2725 across the device 2740. By one approach, the gathering device 2740 defines a notch 2742 into which the stretch film 2725 is guided by the arms 2744 of the gathering device 2740 to facilitate the "roping" of the stretch film 2725. Because the gathering device 2740 is independently rotatable, a user can readily rotate it to engage or disengage the stretch film 2725 to selectively gather or not gather the stretch film 2725 into a string or rope 2750 during continuous (or in between uses) dispensing of the stretch film 2725 from the roll 2720 to selectively apply stretch film or string/rope to an object. Like the example of FIG. 26, a locking mechanism 2760 may be incorporated to lock down rotation of the rotatable member 2735 and/or the gathering device 2740. So configured, the dispenser 2700 provides further flexibility in how the stretch film is manipulated into a rope or string while applying it to secure a load.

Figure 29:
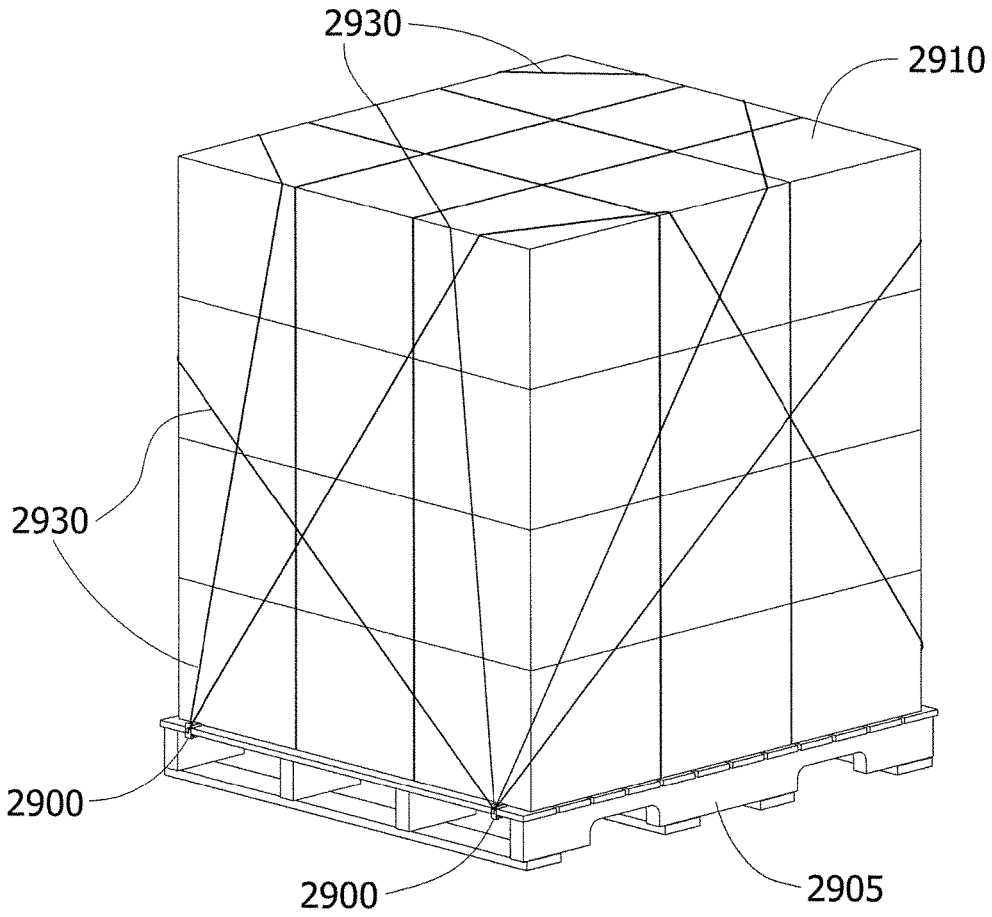

Rope or string, such as the gathered stretch film as discussed above, can be used to secure a load or object to pallet using attachment devices. With reference to FIG. 29, an attachment apparatus 2900 configured to attach to a pallet 2905 configured to support the object or load 2910. The attachment apparatus 2900 defines an engagement surface 2920 configured to engage a rope or string 2930, such as a string of stretch film, to secure it to the pallet 2905. The attachment apparatus 2900 can have a variety of forms and sizes having sufficient strength to grip the pallet and withstand the forces of the string to hold the load to the pallet.

Figure 30:
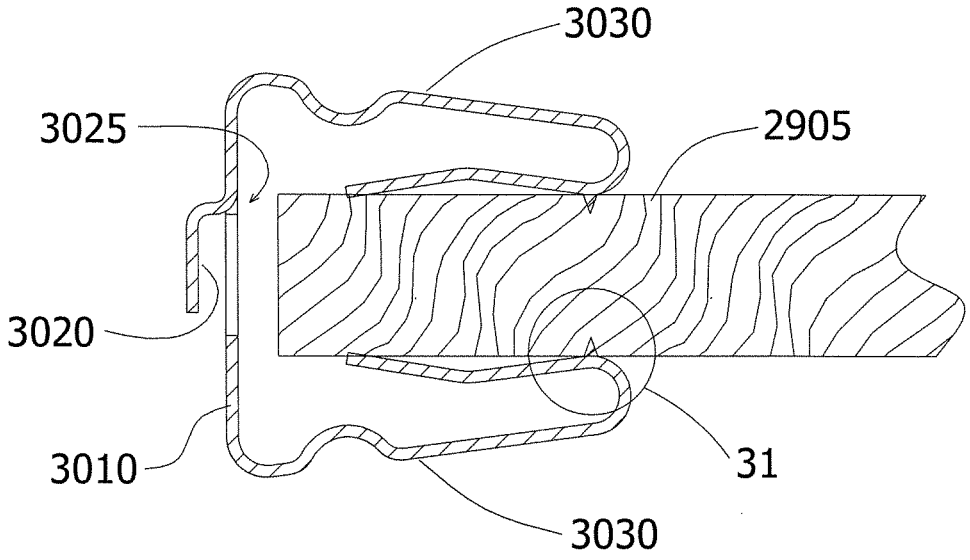
FIG. 30 comprises an elevation view of an example attachment apparatus attached to a portion of a pallet as configured in accordance with various embodiments of the invention.
Figure 31:
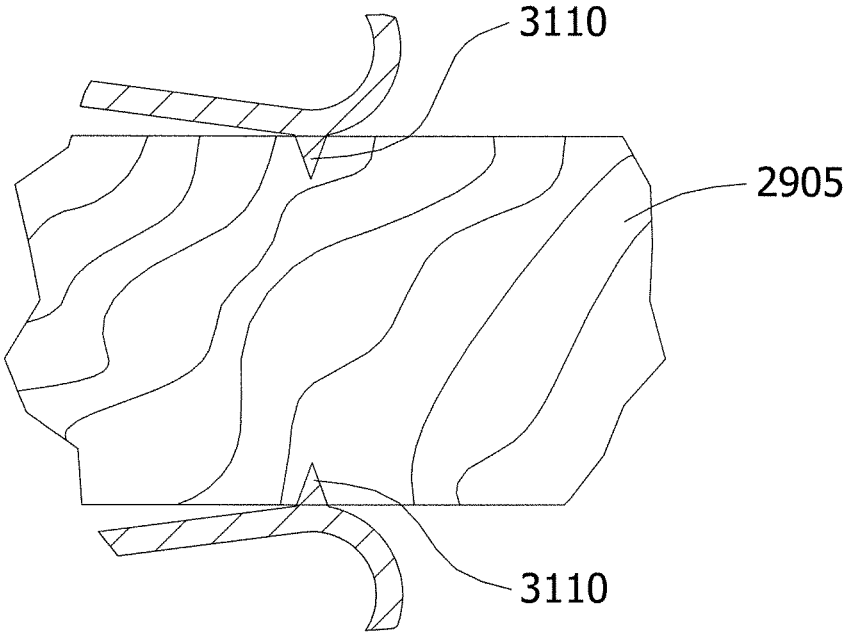
FIG. 31 comprises a zoom in of portion 31 of the attachment apparatus of FIG. 30.

One example attachment apparatus is illustrated in FIG. 30. Here, the attachment apparatus includes a bridge section 3010 and an engagement surface 3020 supported by the bridge section 3010. By one approach, the engagement surface 3020 is the back side of a tab extending from the bridge section 3010. In another approach, the engagement surface can be the back side 3025 of the bridge section 3010. At least two arms 3030 extend from the bridge section 3010. The at least two arms 3030 are biased to pinch a section of the pallet 2905 to secure the apparatus to the pallet 2905. For example, the attachment apparatus may be constructed out of a resilient material like steel, plastic, or other material and shaped with a space between the at least two arms 3030 smaller than a typical pallet section to which the device will attach. Thus, the device can spread open, be placed around or slide onto the pallet portion, and grip onto the pallet. In one approach, the attachment apparatus of FIG. 30 can be a single stamped piece of metal, which can cost effective to manufacture. Optionally, as illustrated in FIG. 31, a friction surface 3110 is disposed on individual ones of the at least two arms 3030. The friction surface 3110 is disposed to engage the pallet 2905. The friction surface 3110 can be a grooved or spiked portion of one or more of the arms 3030 that engages the pallet 2905 to provide additional gripping strength.

Figure 32:
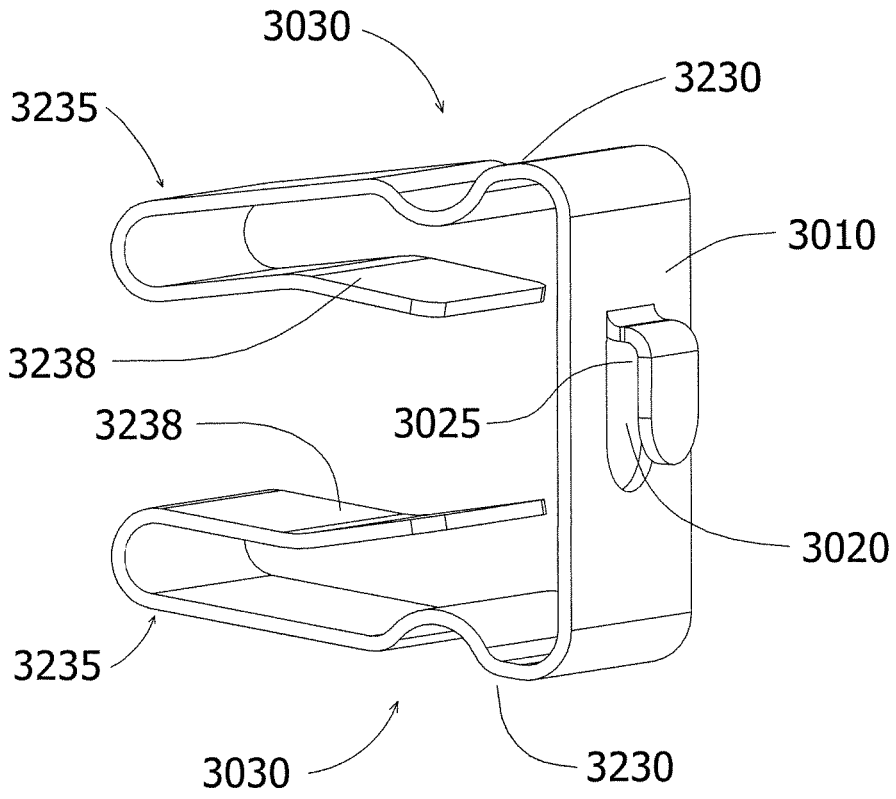
FIG. 32 comprises a perspective view of an example attachment apparatus like that of FIG. 30.

The example attachment device of FIG. 32 illustrates a version where individual ones of the two arms 3030 include a first section 3230 having a distal end 3235 extending away from the bridge section 3010 and a second section 3238 extending from the first section's distal end 3235 and biased inward toward an opposing arm of the at least two arms 3030 to engage the pallet 2905. Friction surfaces 3110 can be provided on any of the surfaces that will engage the pallet. Either or both arms 3030 can have this second portion. Alternatively, the arms 3030 can have only a single portion extending from the bridge section 3010 to engage the pallet 2905.

Figure 33:
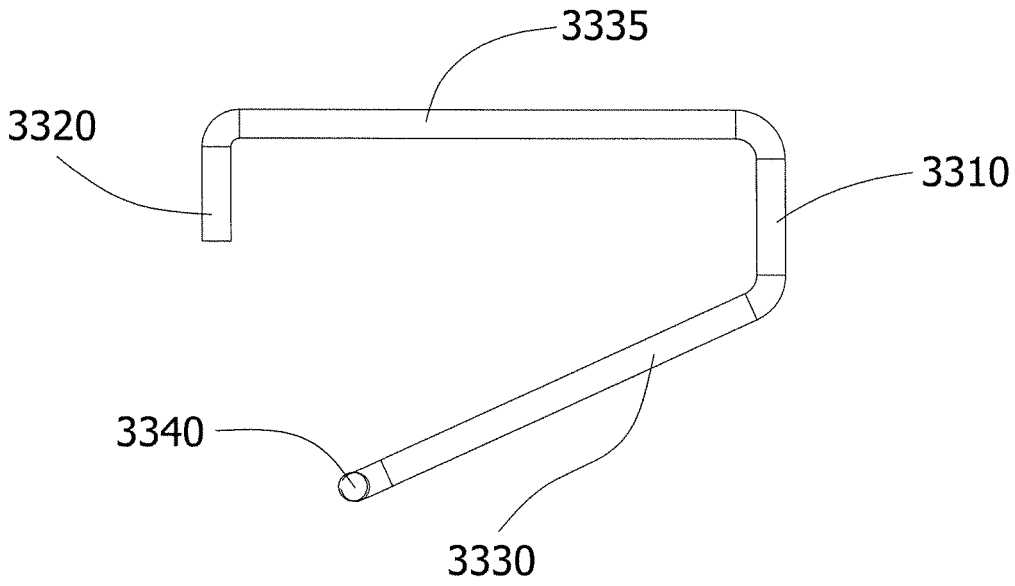
FIG. 33 comprises a side view of an example attachment apparatus attached to a portion of a pallet as configured in accordance with various embodiments of the invention.
Figure 34:
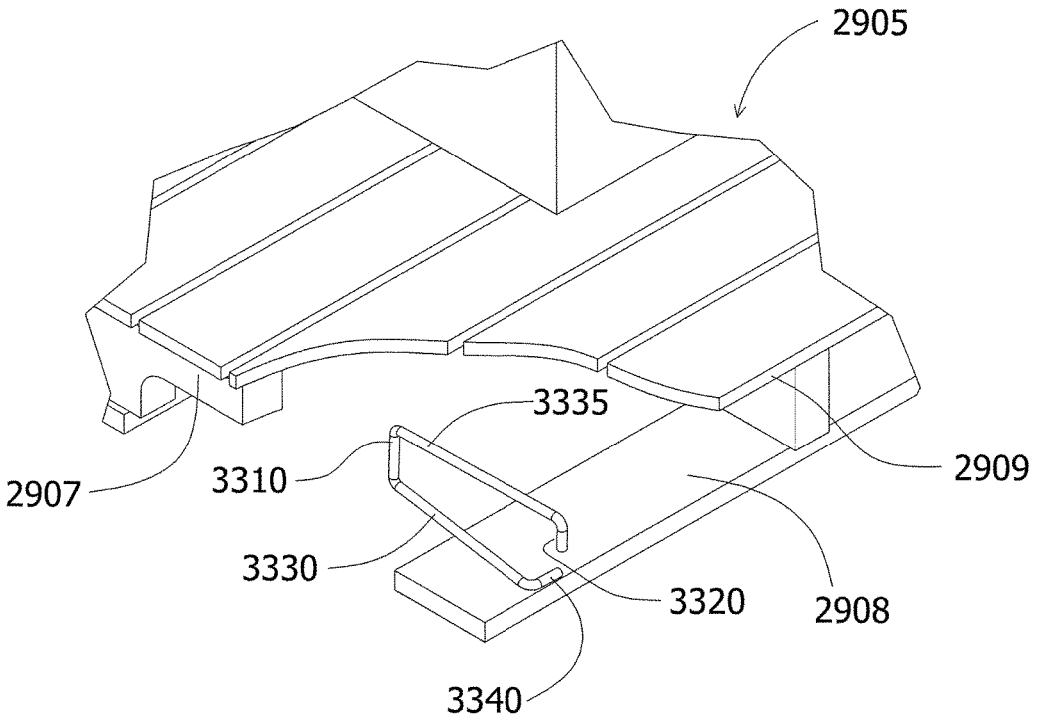
FIG. 34 comprises a perspective view of an example attachment apparatus like that of FIG. 33 disposed in a pallet as configured in accordance with various embodiments of the invention.
Figure 35:
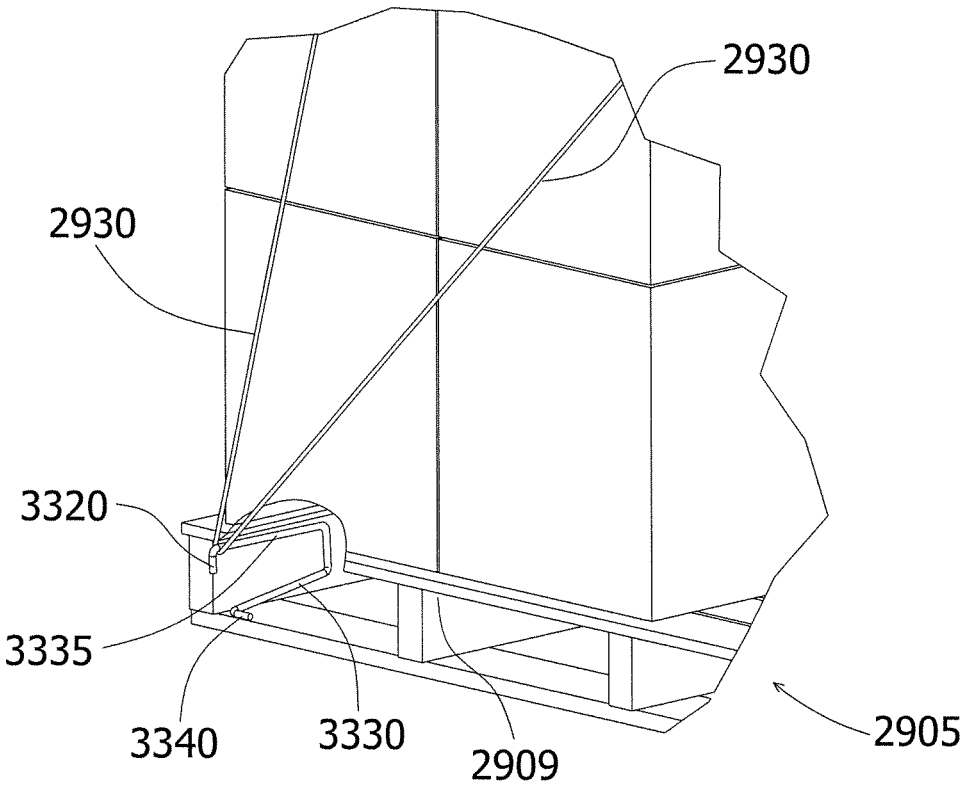
FIG. 35 comprises another perspective view of an example of attachment apparatus like that of FIG. 33 disposed in a pallet and engaging packing material as configured in accordance with various embodiments of the invention.

FIGS. 33-35 illustrate another example attachment apparatus. In this example, the apparatus includes a resilient material configured to engage opposing inner surfaces of a pallet 2905. The apparatus includes a middle elongated portion 3310 configured to be inserted into the pallet 2905 in a generally vertical orientation. A first elongated arm 3330 and a second elongated arm 3335 extending from the middle elongated portion 3310 wherein the elongated arms 3330 and 3335 are disposed to engage the opposing inner surfaces 2907 and 2908 of the pallet 2905. The first elongated arm 3330 is shorter than the second elongated arm 3335 and has an extension arm 3340 extending from an end of the first elongated arm 3330 distal from the middle elongated portion 3310. The extension arm 3340 is configured to engage an inner surface 2908 of the pallet 2905 to restrict rotation of the resilient material in the pallet 2905. The engagement surface 3320 extends from an end of the second elongated arm 3335 distal from the middle elongated portion 3310. The engagement surface 3320 extends beyond an outer edge 2909 of the pallet 2905 to engage a securing material 2930, such as gathered stretch film. One or both of the elongated arms 3330 and 3335 of this example can be disposed to extend from the middle portion 3310 obliquely as illustrated in FIG. 33 to encourage engagement with the pallet 2905. When placed in the pallet 2905, the opposing inner surfaces 2907 and 2908 of the pallet 2905 displace the elongated arms 3330 and 3335 as illustrated in FIG. 34 to create a friction fit, thereby securing the apparatus within the pallet 2905. This example approach can be manufactured from a thick gage metal wire bent to have the described form.

Figure 36:
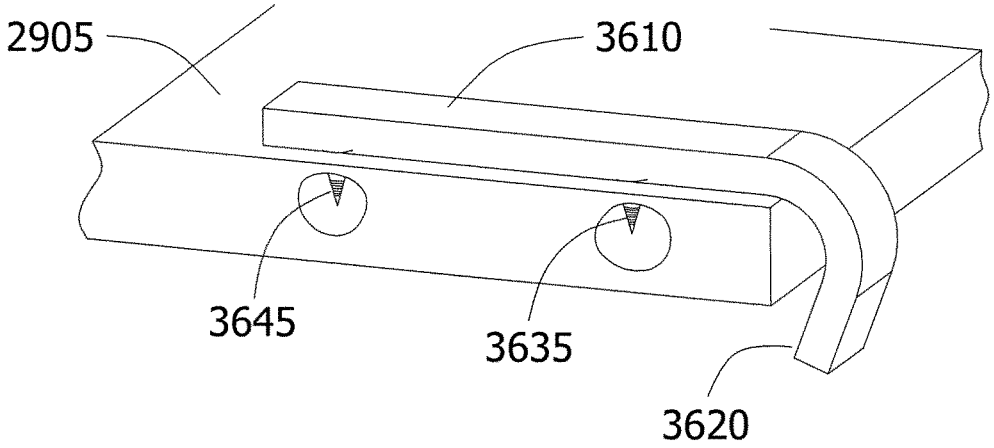
FIG. 36 comprises a perspective view of an example attachment apparatus as configured in accordance with various embodiments of the invention.

FIG. 36 illustrates a further example attachment apparatus. In this example, a body section 3610 supports an engagement surface 3620, which is configured to engage a securing material. A protrusion 3635 extends from the body section 3610 and is configured to be embedded into a surface of a pallet 2905 to secure the body section 3610 and the engagement surface 3620 relative to the pallet 2905. In the illustrated example, the protrusion 3635 has a nail-like profile that can be driven into the pallet 2905. In another example, the protrusion 3635 can be shaped like a nub that embeds only partially into the pallet 2905. Optionally, a second protrusion 3645 extends from a section of the body section 3610 distal from the engagement surface 3620. In this example, the protrusion 3635 is disposed between the second protrusion 3645 and the engagement surface 3620, wherein the second protrusion 3645 is configured to engage or embed into the pallet 2905. For example, the second protrusion 3645 can have a nail-like profile that is driven into the pallet 2905 such that forces on the engagement portion 3620 may torque the attachment device about the first protrusion 3635 to drive the second protrusion into stronger engagement with the pallet 2905.

Figure 37:
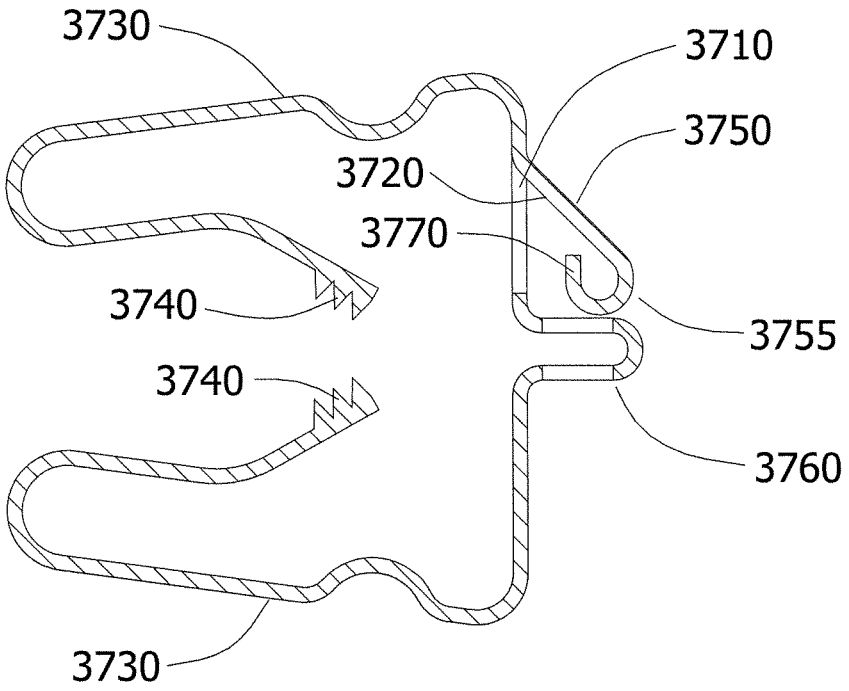
FIG. 37 comprises a side view of an example attachment apparatus as configured in accordance with various embodiments of the invention.
Figure 38:
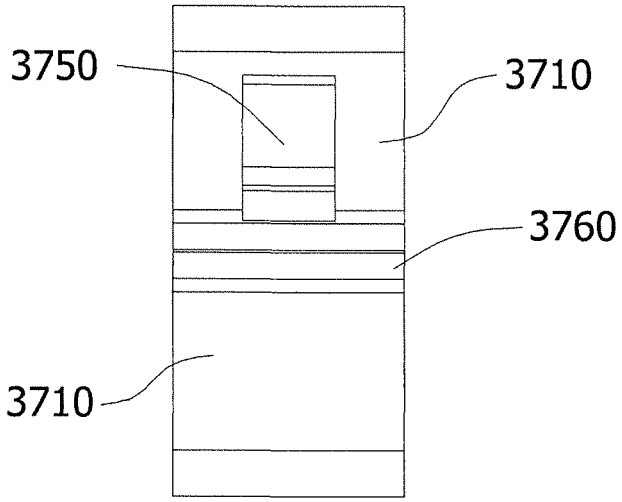
FIG. 38 comprises a front view of the example attachment apparatus of FIG. 37.

FIGS. 37 and 38 illustrate yet another example attachment apparatus including a modification to that of FIGS. 30-32 above. In this version, the attachment apparatus includes a bridge section 3710 and an engagement surface 3720 supported by the bridge section 3710. At least two arms 3730 extend from the bridge section 3710. At least a portion of the at least two arms 3730 are biased to pinch a section of the pallet to secure the apparatus to the pallet. For example, the attachment apparatus may be constructed out of a resilient material like steel or other metal and shaped with a space between the at least two arms 3730 smaller than a typical pallet section to which the device will attach. Thus, the device can spread open, be placed around or slide onto the pallet portion, and grip onto the pallet. In one approach, the attachment apparatus of FIG. 30 can be a single stamped piece of metal, which compared to alternatives may be more cost effective to manufacture. Optionally, a friction surface 3740 is disposed on individual ones of the at least two arms 3730 to engage the pallet.

The engagement surface 3720 in this example is defined by a tab 3750 extending from the bridge section 3710, which in turn defines a ridge 3760 extending from the bridge section 3710 toward a distal end 3755 of the tab 3750. The tab 3750 optionally defines a hook 3770 extending toward the bridge section 3710. The tab/ridge arrangement helps secure the packing material to the attachment apparatus during the wrapping process. For instance, if the tab 3750 and ridge 3760 are close enough, a user would need to depress the tab 3750 to insert the string or rope to be secured to the pallet to effectively lock the string or rope in place. Accordingly, the shape of the ridge 3760 may vary in different applications or when using different manufacturing processes for the apparatus to provide this locking effect.

Various features of the above example attachment apparatuses can be implemented in other ones of the example. For instance, the placement of the friction surface at the very end of the arms 3730 of the FIG. 37 example could be implemented in the example of FIG. 30. The friction surfaces could be applied to any surface of any of the examples expected to contact the pallet. The hook 3770 of the FIG. 37 example could be implemented without the ridge 3760, such as in the FIG. 30 example. Similarly, the ridge 3760 could be implemented without the hook 3770.

Figure 39:
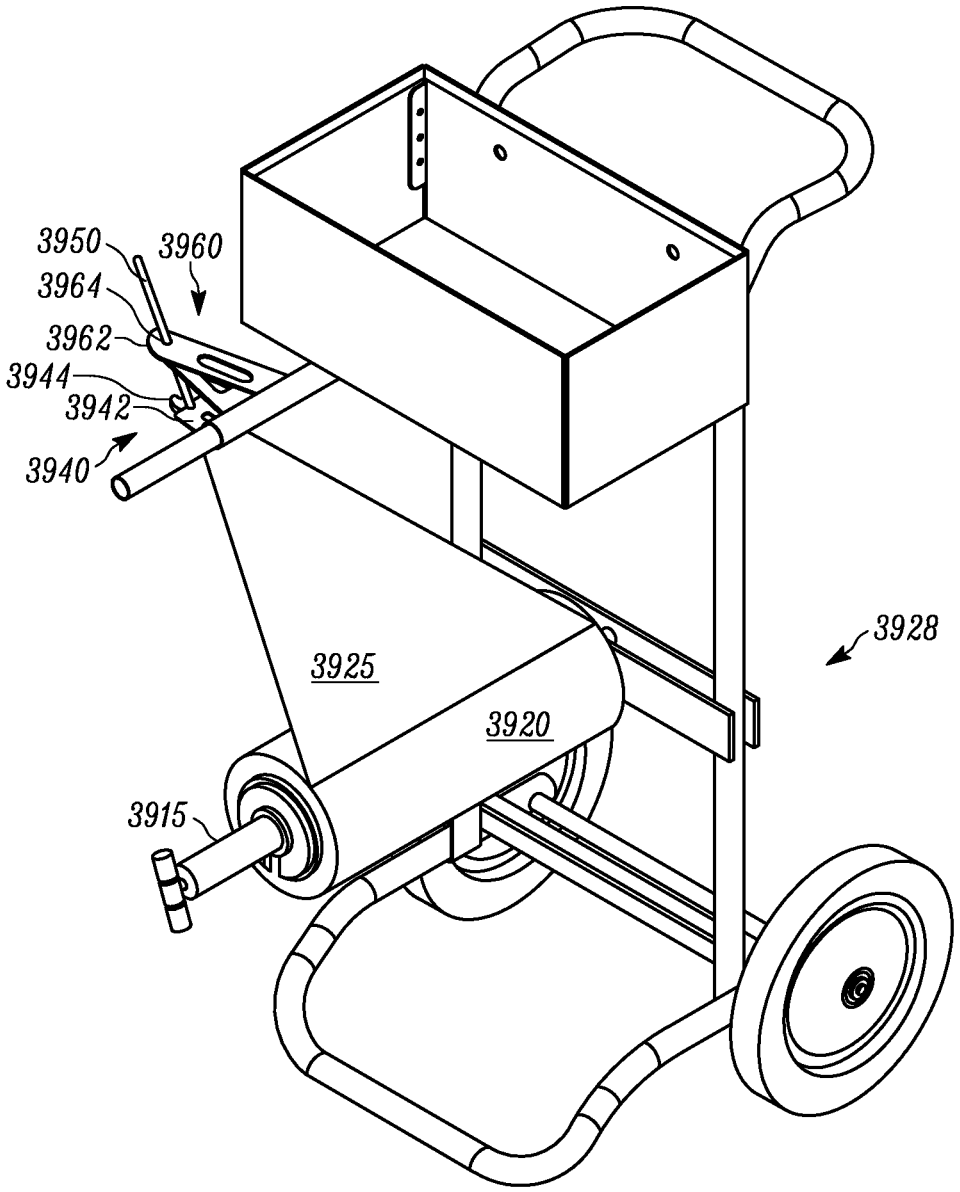
FIG. 39 comprises a perspective of an example stretch film dispenser for creating string or rope as configured in accordance with various embodiments of the invention.
Figure 40:
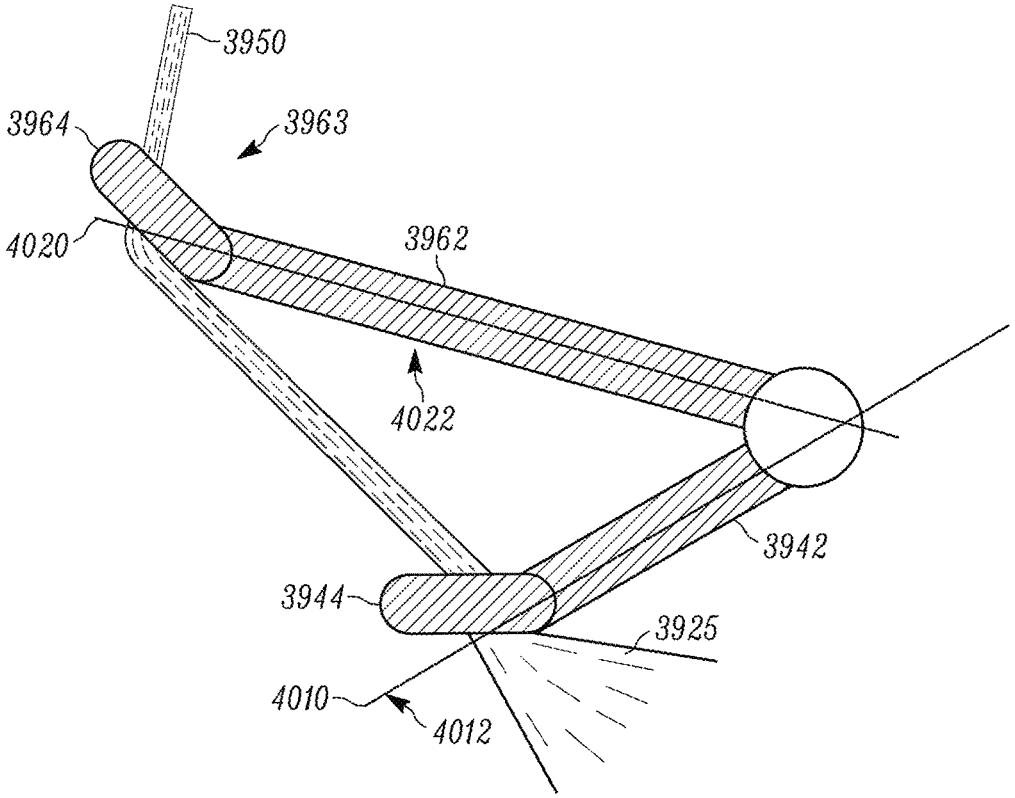
FIG. 40 comprises a side plan view of example first and second gathering devices used with an example stretch film dispenser for creating string or rope as configured in accordance with various embodiments of the invention.

FIGS. 39 and 40 illustrate a further example of an apparatus for dispensing stretch film for application to an object. In this example, a support frame 3915 is configured to support a roll 3920 of stretch film and dispense the stretch film 3925 in response to tension on the stretch film 3925. The support frame 3915 in this example is mounted onto a cart 3918 to facilitate movement around a shipping facility. The cart 3918 supports a first gathering device 3940 that is disposed to stretch and gather the stretch film 3925 into a string 3950 configured to wrap around the object. In one approach, the first gathering device 3940 includes a flange 3942 extending in a first plane 4010. The roll 3920 of stretch film 3925 is disposed to dispense the stretch film 3925 toward the first gathering device 3940 from a first side 4012 of the first plane 4010. A hook device 3944 extends from an end of the flange 3942 distal from the roll 3920 of stretch film 3925 and oblique relative to the first plane 4010 in a direction opposite the first side 4012 of the first plane 4010.

A second gathering device 3960 is disposed to receive the string 3950. The second gathering device 3960 is configured to, in response to a pulling force exerted on the string 3950 away from the second gathering device 3960 and from the first gathering device 3940, one or both of: 1) stretch the string 3950 and 2) twist the string 3950. By one approach, the second gathering device 3960 includes a second flange 3962 extending in a second plane 4020, wherein the second gathering device 3960 is disposed to receive the string 3950 from the first gathering device 3940 from a first side 4022 of the second plane 4020. The second gathering device 3960 in this example defines an aperture 3963 configured to engage and stretch the string 3950. The aperture 3963 is defined by an extension 3964 extending from an end the second flange 3962 distal from the roll 3920 of stretch film 3925 and oblique relative to the second plane 4020 in a direction opposite the first side 4022 of the second plane 4020. In a different approach, the second gathering device comprises a set of dual action gears configured to rotate in response to a pulling action on the string and to engage the string to stretch and twist the string during extraction of the string from the apparatus.

Figure 41:
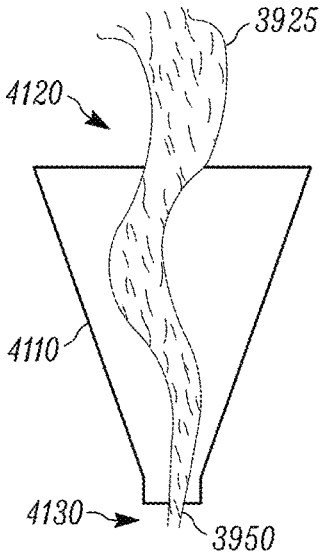
FIG. 41 comprises a cross-sectional view of an example funnel based gathering device as configured in accordance with various embodiments of the invention.

In various approaches, a portion of the second gathering device 3960 that is configured to engage the string 3950 provides a smaller space through which the string passes as compared to a portion of the first gathering device 3940 that is configured to engage the stretch film 3925 to stretch and gather the stretch film 3925 into the string 3950. This step down approach increases the amount of stretch applied the stretch film when forming it into a string, which in turn increases the resulting string's strength in securing an object, for example, to a pallet. FIG. 41 illustrates one such apparatus used for this string preparation. The illustrated approach can be applied to one or both of the first gathering device 3940 and the second gathering device 3960. As illustrated, a funnel 4110 is configured to receive the stretch film 3925 or string 3950 through a large end 4120 of the funnel 4110 and engage, gather, and stretch the stretch film 3925 or string 3950 as it passes through the large end 4120 of the funnel 4110 to and through a small aperture 4130 of the funnel 4110.

Figure 42:
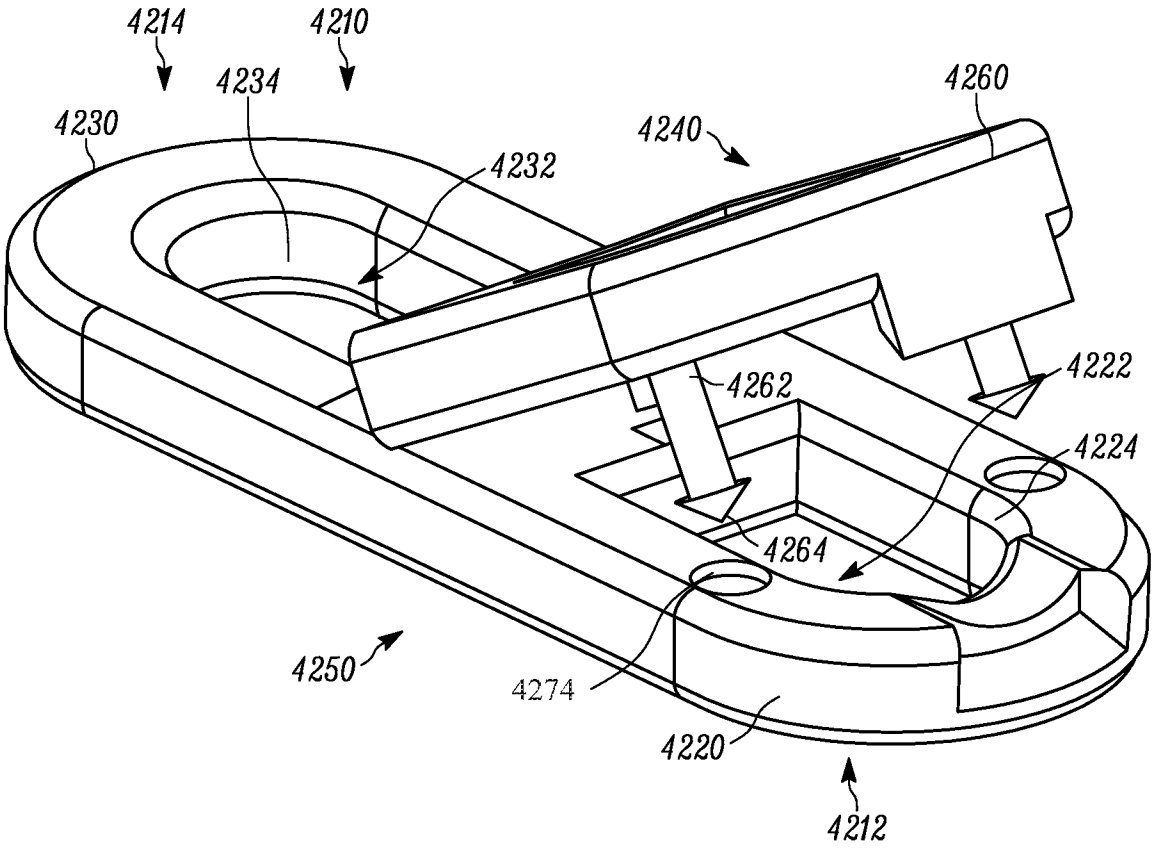
FIG. 42 comprises a perspective view of an example clip or clamp apparatus to secure ends of stretch film string as configured in accordance with various embodiments of the invention.

Because a string 3950 of stretch film 3925 can slip when tied to itself, a clip or clamp can be used to secure opposing sends of the string 3950 in a secure manner around the object. As illustrated in FIG. 42, an example of such an apparatus includes a longitudinal body 4210 having a first end 4212 and a second end 4214 opposite to the first end 4212. The longitudinal body 4210 includes a first portion 4220 that defines at the first end 4212 a first aperture 4222 having a curved section 4224 on an inner portion of the first aperture 4222 curving inwardly away from the first end 4212 and toward the second end 4214. The longitudinal body 4210 also includes a second portion 4230, separate and distal from the first portion 4220, that defines at the second end 4214 a second aperture 4232 having a curved section 4234 on an inner portion of the second aperture 4232 curving inwardly away from the second end 4214 and toward the first end 4212.

The apparatus also includes at least one a clamping portion 4240 rotatably secured to a middle portion 4250 of the longitudinal body 4210 and having a shape substantially corresponding to the first portion 4220 of the longitudinal body 4210. The clamping portion 4240 includes a latch 4260 configured to engage at least a portion of the first portion 4220 of the longitudinal body 4210 to secure a portion of the string between the clamping portion 4240 and the longitudinal body 4210. Although various latch designs can be used, in the illustrated example, the latch 4260 comprises at least one post 4262 extending from the clamping portion 4240 toward the first portion 4220 of the longitudinal body 4210. The post 4262 includes a detent 4264 configured to engage and lock with a corresponding aperture 4274 in the first portion 4220 of the longitudinal body 4210. Moreover, the clip or clamp can further include a second clamping portion clamping on the second portion of the longitudinal body and having features just like those of the first clamping portion. The whole clamping apparatus can be molded plastic with the clamping portion being integral with the rest of the body, where the plastic is flexible enough to allow the clamping portions to pivot about its connection to the middle portion of the longitudinal body. In another approach, the clamping apparatus or latch can be a separate piece pivotally secured to the middle portion of the longitudinal body. Additional approaches to the clip are described in U.S. Provisional Patent Application No. 61/990,515 filed May 8, 2014, U.S. Provisional Patent Application No. 62/029,099 filed Jul. 25, 2014, and U.S. Design patent application No. 29/503,350 filed Sep. 25, 2014, each of which are incorporated by reference herein in their entireties.

In use, the stretch film dispenser of FIGS. 39 and 40 and the clip or clamp of FIG. 42 can be used to secure an object to a pallet. For instance, stretch film is dispensed from a roll of stretch film supported by a support frame, and a first gathering device engages the stretch film to stretch and gather the stretch film into a string using any of the example gathering devices described herein. A second gathering device engages the string coming from the first gathering device to one or both of stretch the string and twist the string. The effect on the string is in response to a pulling force exerted on the string away from the second gathering device and the first gathering device. The string then engages the object and an inner surface of a pallet. A first end of the string is secured by a first end of the longitudinal body, for example, by being clamped by a clamping portion of the longitudinal body. A second end of the string is pulled through by a second end of the longitudinal body to tighten the grip around the object and then secured by the second end, for example, by being clamped by a second clamping portion of the longitudinal body.

Figure 43:
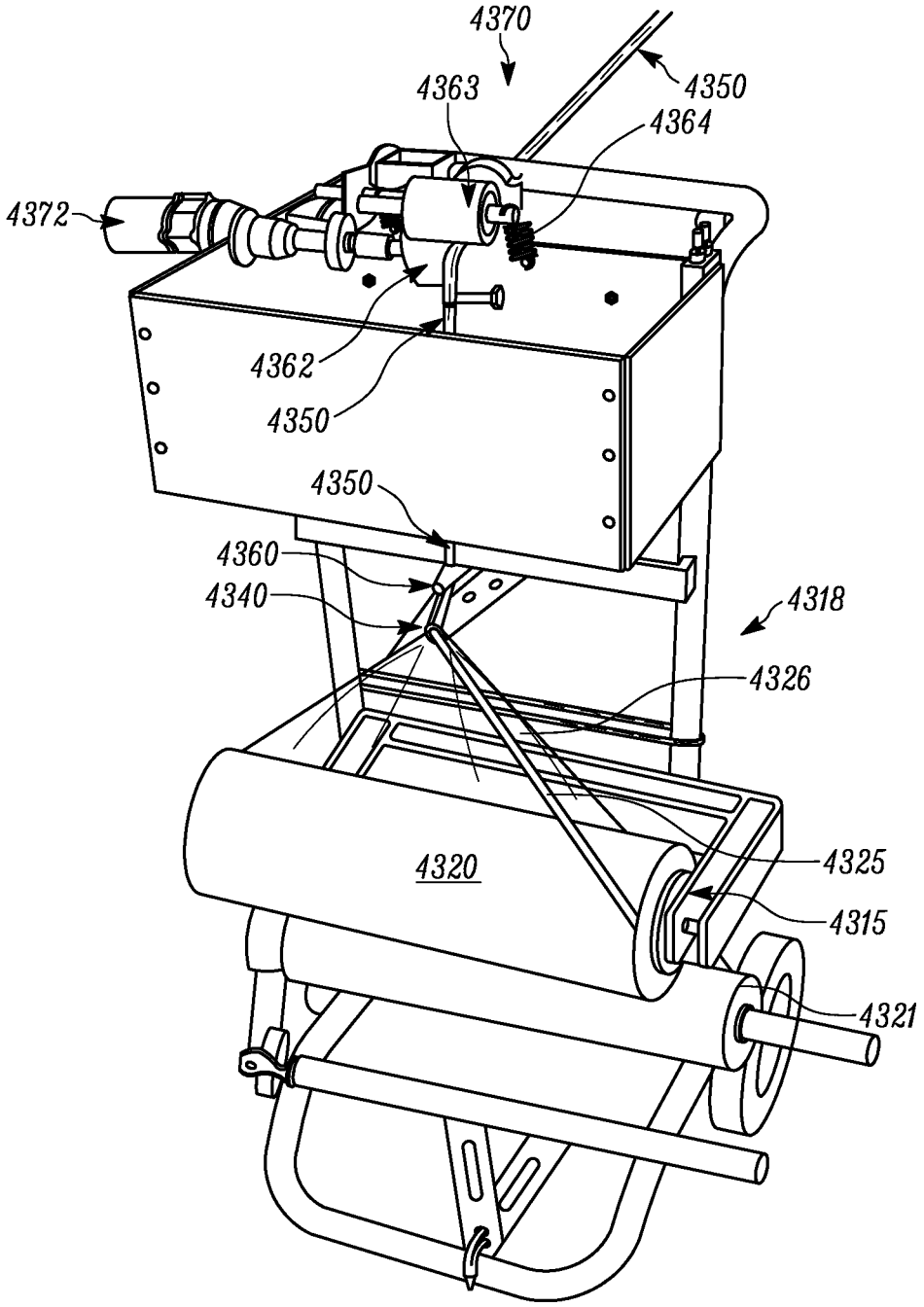
FIG. 43 comprises a perspective view of an example stretch film dispenser for creating string or rope as configured in accordance with various embodiments of the invention.
Figure 44:
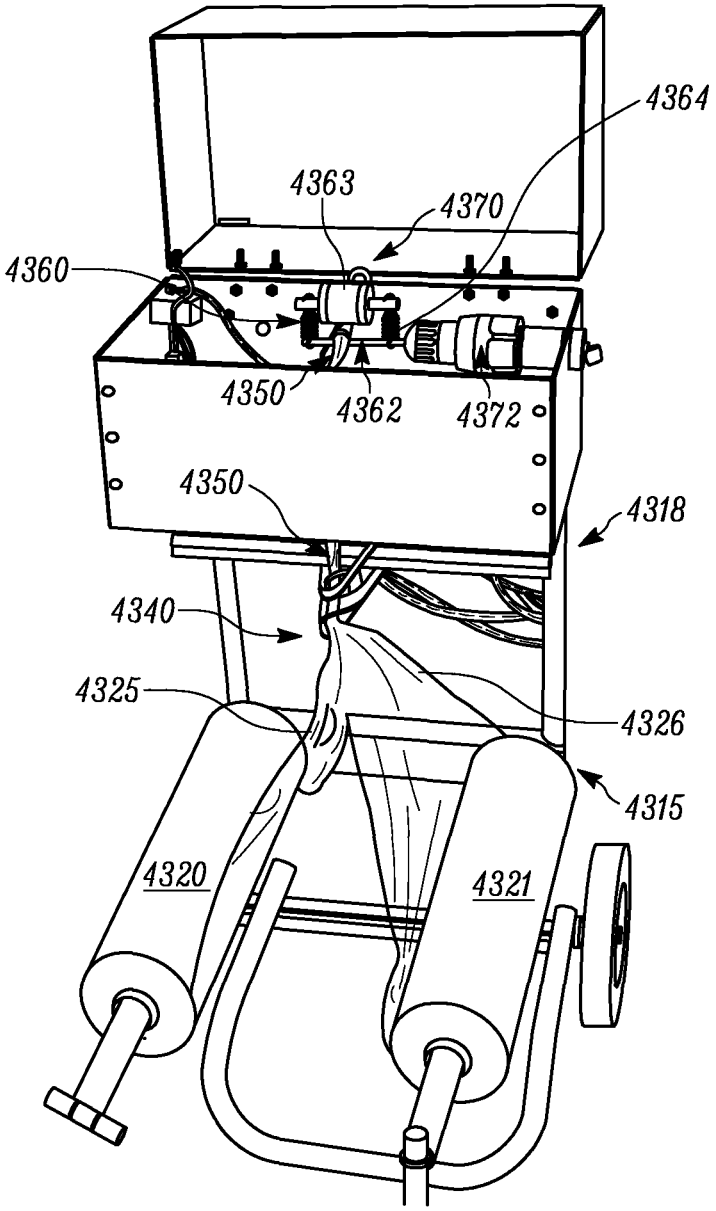
FIG. 44 comprises a perspective view of another example stretch film dispenser for creating string or rope as configured in accordance with various embodiments of the invention.

Further example approaches to a roper device that creates a string or rope from stretch film are described with reference to FIGS. 43-49. FIGS. 43 and 44 illustrate two different approaches to the roping device where parts with the same number perform the same function. In these examples, a support frame 4315 is configured to support a roll 4320 (alone or together with a second roll 4321) of stretch film and dispense the stretch film 4325 (and optionally film 4326 from the second roll 4321) in response to tension on the stretch film 4325. The support frame 4315 in these examples is mounted onto a cart 4318 to facilitate movement around a shipping facility. The cart 4318 supports a first gathering device 4340 that is disposed to stretch and gather the stretch film 4325 into a string 3950 configured to wrap around the object. The first gathering device 4340 may include two substantially similar elements. In this example, the first gathering device 4340 is similar to that of FIG. 39 in that it defines an aperture that forces stretch film to bind together into a string or rope as it passes through the aperture, although other gathering devices can be used to collect the stretch film into a string or rope.

Figure 45:
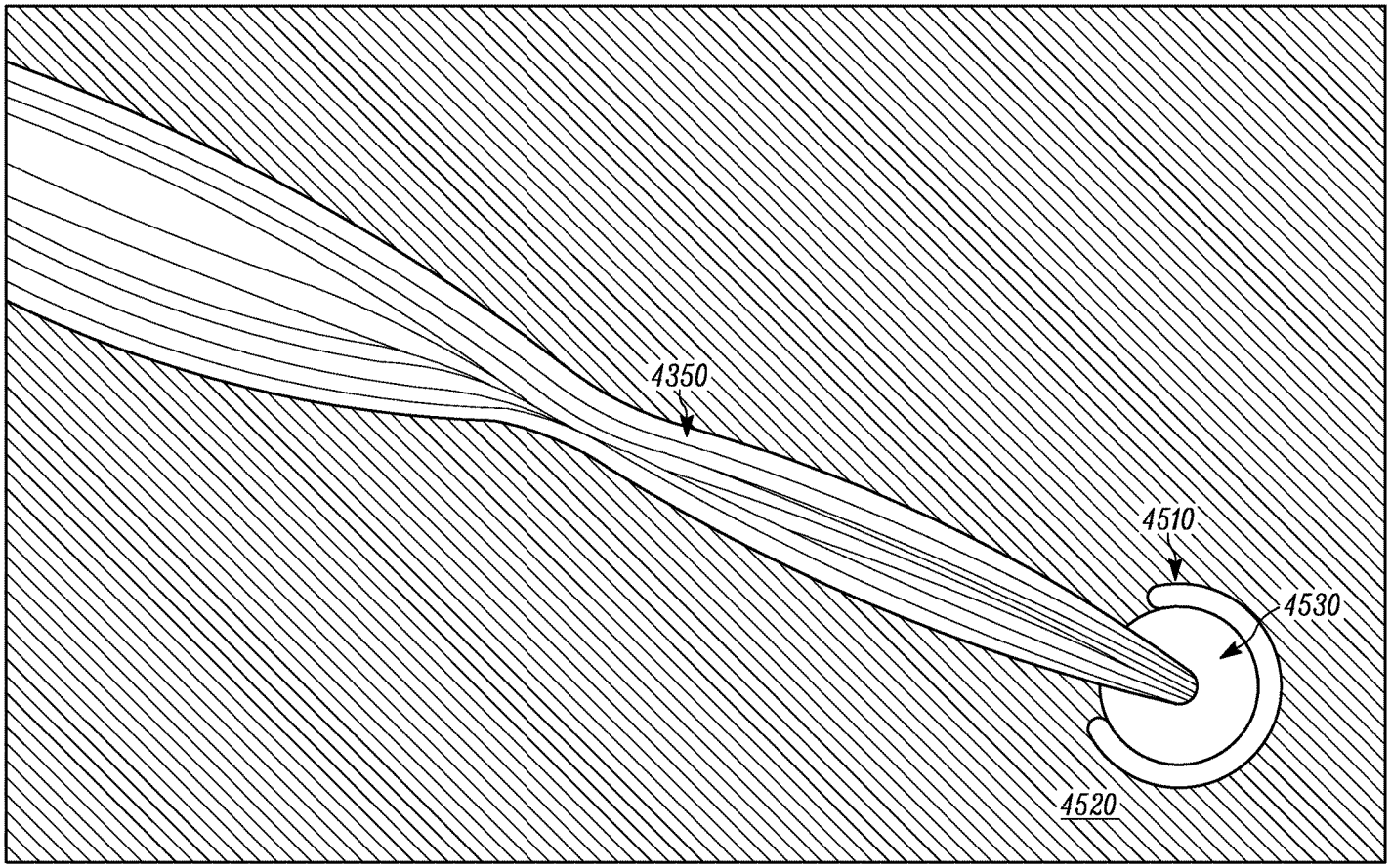
FIG. 45 comprises a perspective view of an example aperture through which stretch film string or rope is pulled as configured in accordance with various embodiments of the invention.

FIG. 45 illustrates one example approach to the first gathering device 4340 where two flanges 4341 and 4342 work together to engage, stretch, and gather the stretch film 4325 (and optionally together with film 4326). The first flange 4341 includes an end portion 4342 that is bent toward the roll of the stretch film 4325 relative to the rest of the first flange 4341. The end portion 4342 defines a slot 4343 that is closed on three sides and open on a fourth side in which the stretch film is slotted at the beginning of the operation. The three closed sides of the slot 4343 engage the stretch film 4325. The second flange 4345 includes an end portion 4346 that is bent away from the roll of the stretch film 4325. Like the first flange 4341, the end portion 4346 of the second flange 4345 defines a slot 4347 that is closed on three sides and open on a fourth side in which the stretch film is slotted at the beginning of the operation. The three closed sides of the slot 4347 engage the stretch film 4325. The second end portion 4345 is arranged so that its open side is directed toward a closed side of the first flange's slot 4343 to ensure engagement on all sides of the stretch film 4325 as it passes through the first gathering device 4340. The end portions 4342 and 4346 are positioned to have a small space 4344 between them that is large enough to allow placement of the stretch film 4325 at the beginning of the operation, but small enough that the stretch film 4325 will not slip out of the first gathering device 4340 during operation.

In the examples of FIGS. 43-49, the resulting string 4350 passes through an aperture 4510 defined in a housing 4520 for the second gathering device 4360. One example of the aperture 4510 is illustrated in FIG. 45. The housing 4520 may be any suitable enclosure to allow safe operation of the device. The aperture 4510 may be defined at least in part by a polymeric lining 4530 that provides the edge that defines the hole and engages the stretch film string 4350 as it passes through the aperture 4510. This engagement may further stretch and strengthen the string 4350. In a manually operated approach, the string 4350 passing through this aperture 4510 can be used to secure an object. Optionally, a second gathering device can be additionally applied to the string 4350 to further improve its strength characteristics.

Figure 46:
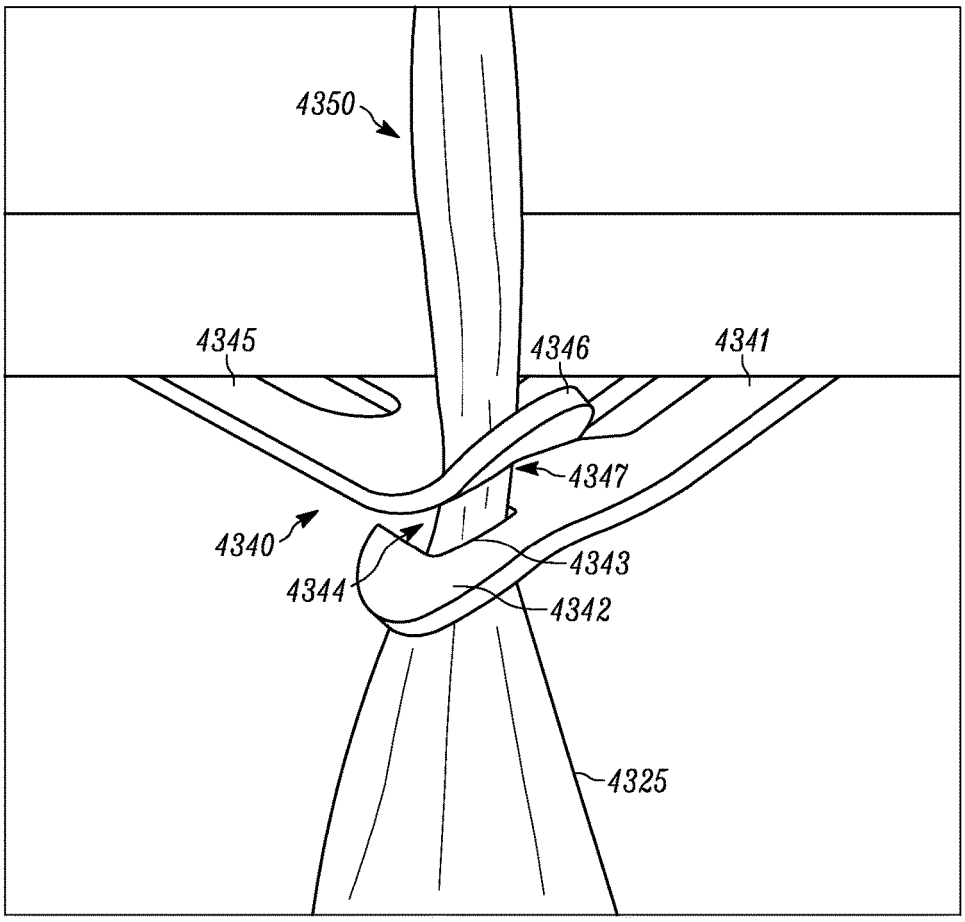
FIG. 46 comprises a perspective view of an example gathering device for a stretch film dispenser for creating string or rope as configured in accordance with various embodiments of the invention.
Figure 47:
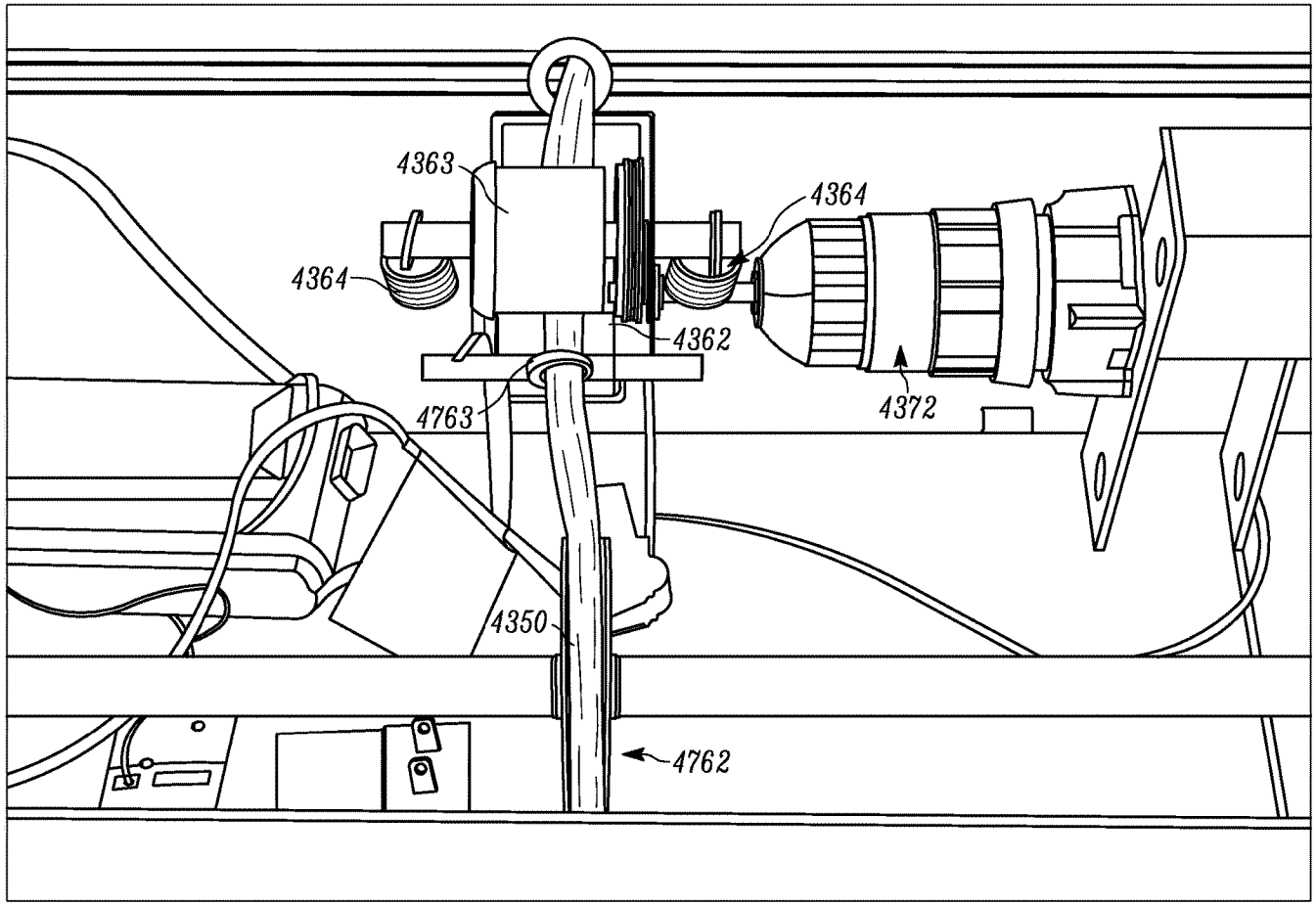
FIG. 47 comprises a perspective view of an example second gathering device for a stretch film dispenser for creating string or rope as configured in accordance with various embodiments of the invention.

Turning to FIGS. 46 and 47, an example of the second gathering device will be described. The string 4350 passes through the aperture 4510 over a pulley 4762 to be fed a stretching and twisting apparatus 4370. Optionally, a ring element 4763 guides the string 4350 to the second gathering device. The stretching and twisting apparatus operates to 1) stretch the string 4350 and 2) twist the string 4350. By one approach, the second gathering device includes a roller 4362 disposed to stretch the string 4350 over at least a portion of the first roller's circumference over which the string 4350 is stretched as it is pulled over the roller 4362. Optionally, a second roller 4363 is biased against the first roller 4362 to contact and tension the string 4350 as the string 4350 moves between the first roller 4362 and the second roller 4363. So configured, the second roller 4363 provides further resistance against the string 4350, thereby stretching and strengthening the string 4350 as a result of the further tensioning on the gathered stretch film. For example, the second roller 4363 is held against the first roller 4362 with springs 4364. By one approach, the first roller 4362 is connected to be driven by an actuator such as a motor 4372 (or other suitable driver) to drive the roller 4320 to pull the string from the first gathering device, thereby tensioning the string 4350 as it is pulled through the gathering device(s) and over and through the rollers 4362 and 4363. Because the stretch film string's strength and retention properties are improved with increased stretching of the material during the "roping" process, application of the motor 4372 can improve the quality of the stretch film string by applying an extra stretching force as compared to a person's pulling the stretch film string through the roping device.

Figure 48:
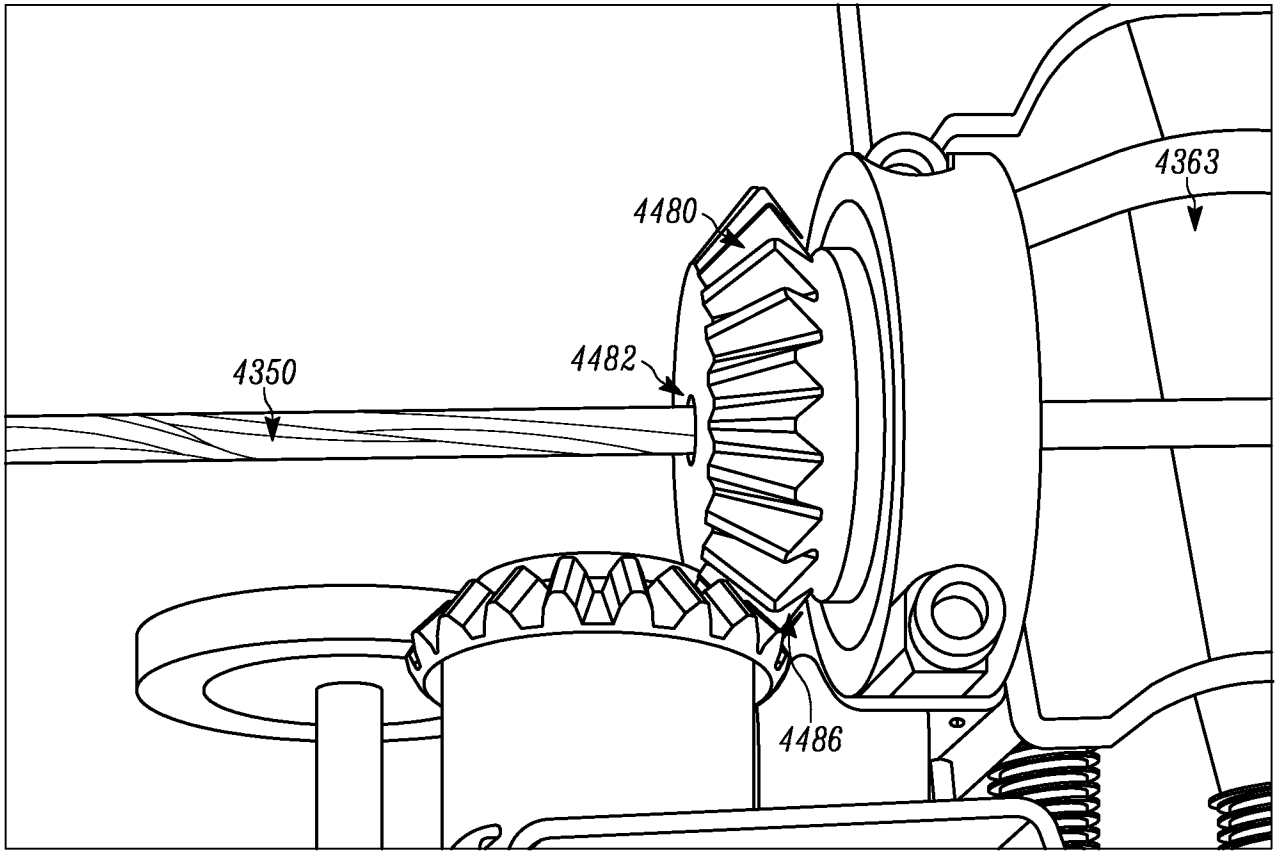
FIG. 48 comprises a top perspective view of an example twisting mechanism for a stretch film dispenser for creating string or rope as configured in accordance with various embodiments of the invention.
Figure 49:
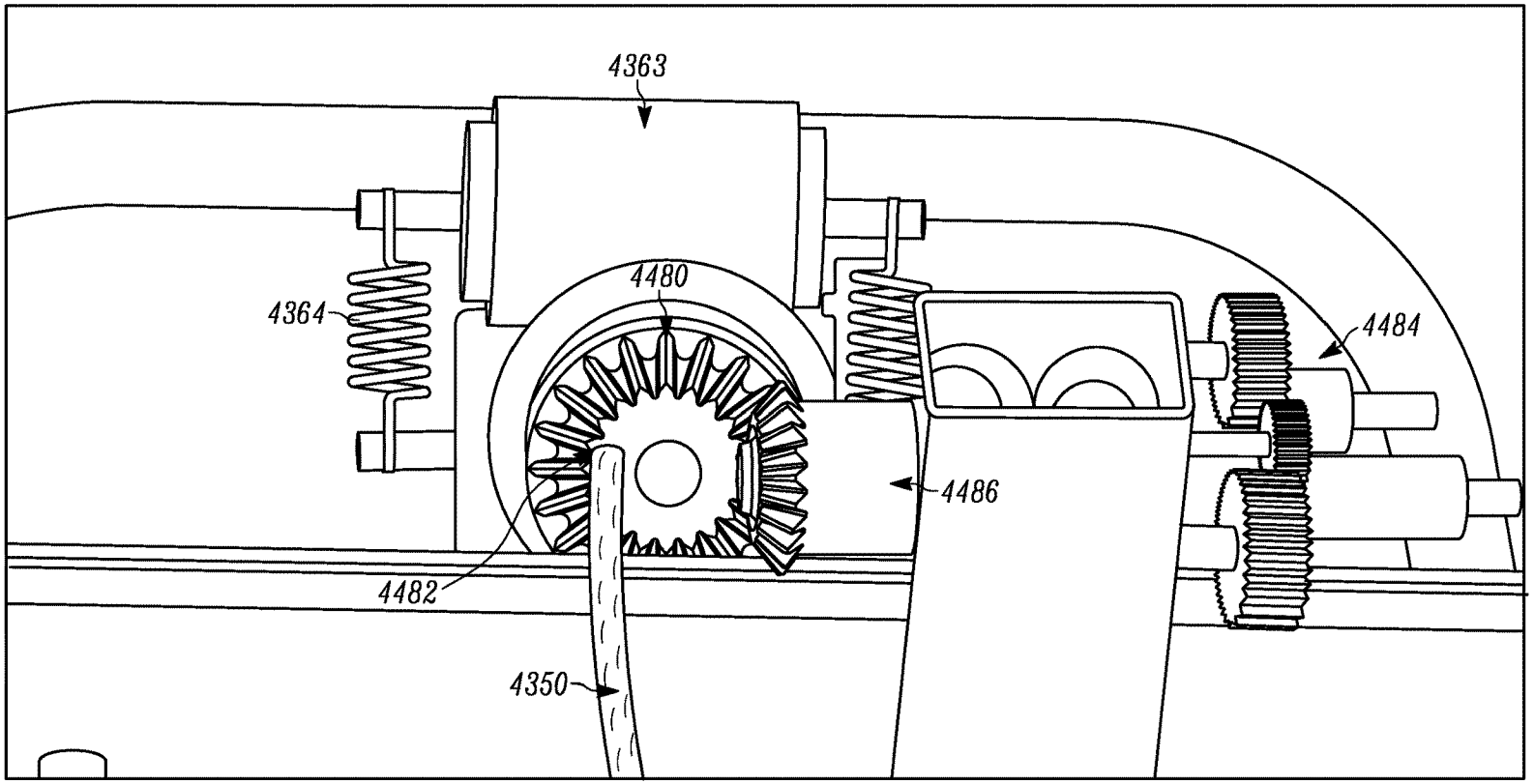
FIG. 49 comprises a back perspective view of another example twisting mechanism for a stretch film dispenser for creating string or rope as configured in accordance with various embodiments of the invention.

In a further aspect, the stretching and twisting apparatus 4370 may also include a twisting element, two examples of which are illustrated in FIGS. 48 and 49. In these examples, the twisting element includes a gear 4480 defining a twisting or gear aperture 4482 having a width configured to engage and twist the string 4350 through rotation of the gear 4480 as the string 4350 passes through the gear aperture 4482. In the illustrated examples, the motor 4372 drives the gear 4480 through a set of gears 4484 including a bevel gear set 4486, although in other applications different gearing or separate motors can be used to drive the gear 4480 and the roller 4362. By rotating the gear 4480 as the string 4350 engages and is pulled through the gear aperture 4482, the string 4350 is further stretched and twisted to provide additional strength to the string 4350. In the example of FIG. 48, the gear aperture 4482 through which the string 4350 passes is defined in the center of the gear 4480. In the example of FIG. 49, the gear aperture 4482 through which the string 4350 passes is defined eccentrically, i.e., offset from the center of the gear 4480 to further facilitate twisting of the string 4350. Twisting the string into a more traditional "rope" form allows for a tighter pack of the material for handling and further stretches the material by adding the additional twisting deformation in the material. Moreover, where two or more stretch films are combined into a single rope, the twisting step helps combine them together into a more coherent single rope as a result of the clinginess of the stretch films as they are deformed against each other.

Although only a couple of examples are described here, other modifications to the stretch film and stretching and twisting processes are possible. For example, and as illustrated in FIGS. 43 and 44, two sheets of stretch film 4325 and 4326 from separate rolls 4320 and 4321, respectively, can be gathered together and stretched and/or twisted together to create a rope having a higher tensile strength. So configured, different stretch film types can be combined to provide different characteristics in the combined string or rope. Additionally, by combining two or more stretch films together into a single rope increases the rope's overall strength.

Figure 50:
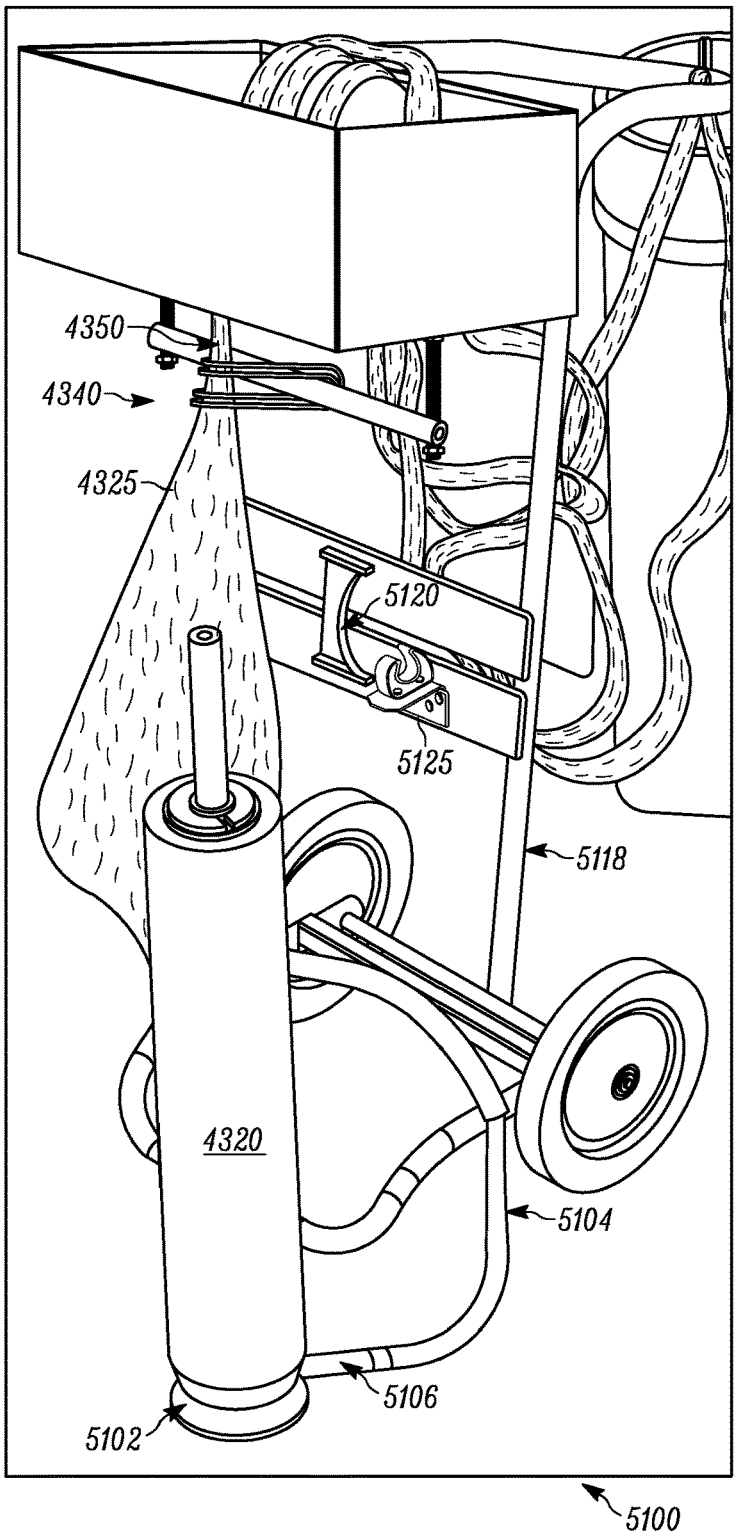
FIG. 50 comprises a perspective view of an example stretch film dispenser for creating string or rope, the dispenser having a mechanism for mounting a hand-held stretch film dispenser as configured in accordance with various embodiments of the invention.
Figure 51:
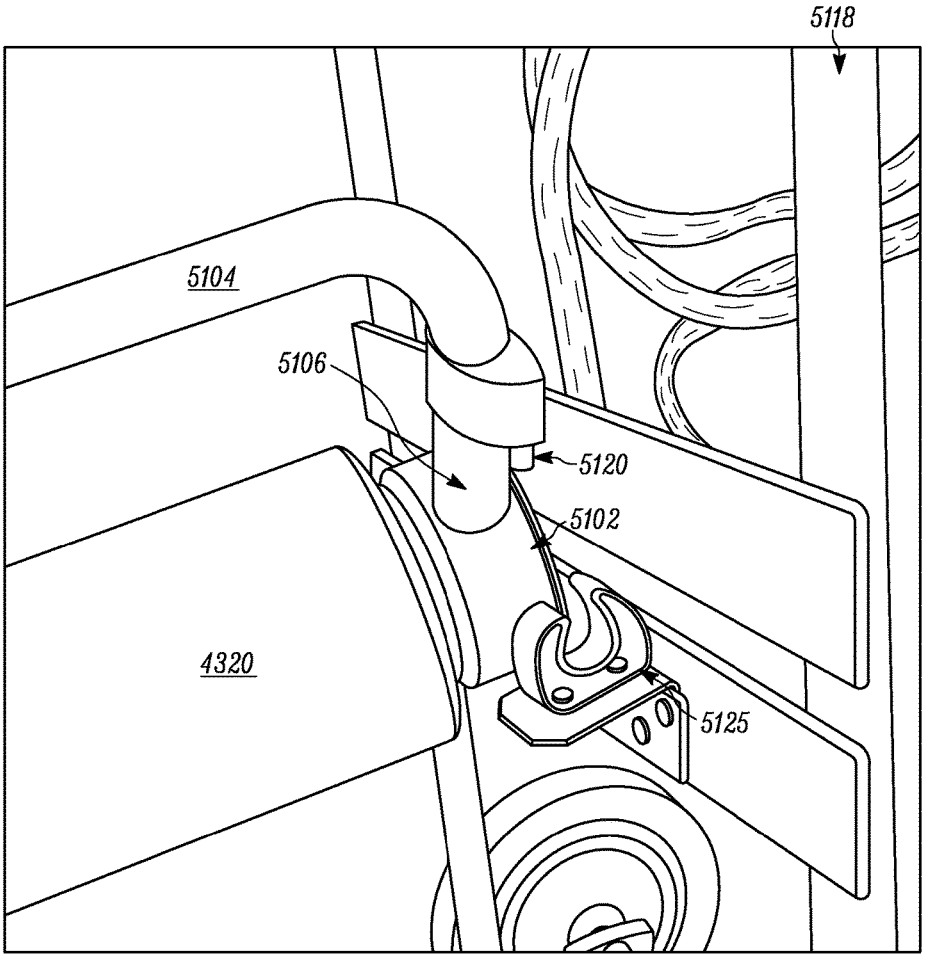
FIG. 51 comprises a perspective view of the mechanism for mounting a hand-held stretch film dispenser of FIG. 50 with a dispenser partially mounted therein as configured in accordance with various embodiments of the invention.
Figure 52:
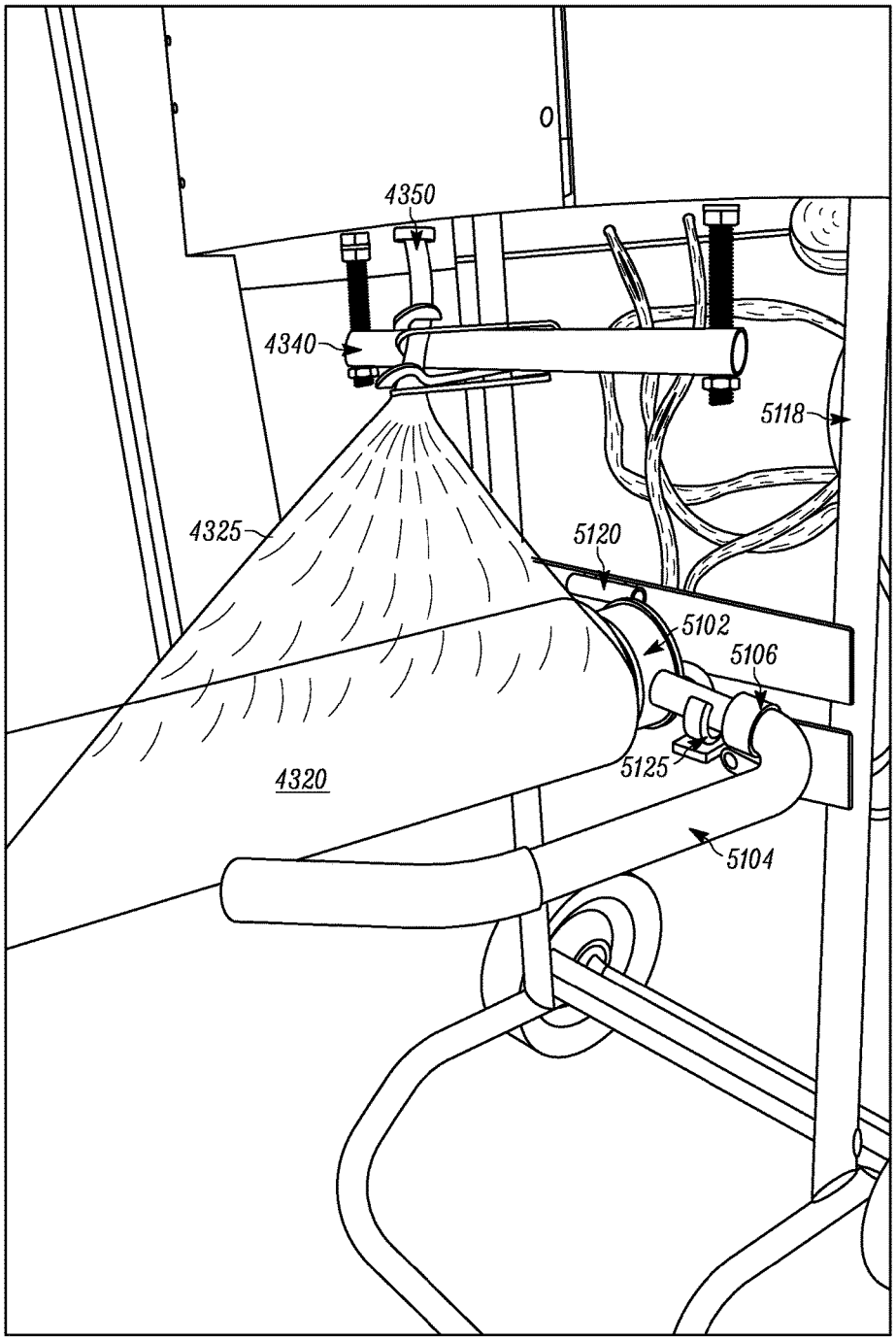
FIG. 52 comprises a perspective view of the mechanism for mounting a hand-held stretch film dispenser of FIG. 50 with a dispenser fully mounted therein as configured in accordance with various embodiments of the invention.
Figure 53:
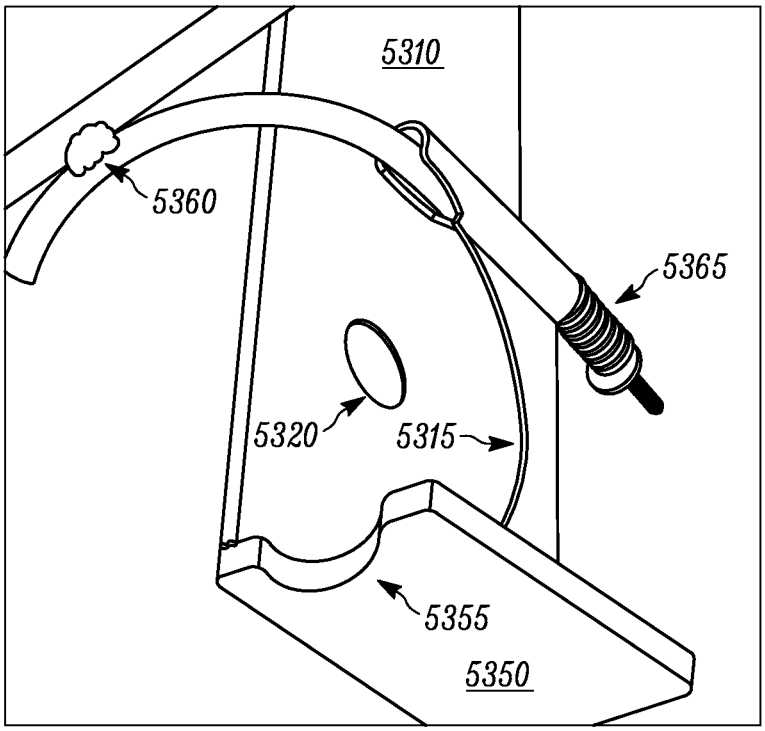
FIG. 53 comprises a perspective view of another example mechanism for mounting a hand-held stretch film dispenser as configured in accordance with various embodiments of the invention.
Figure 54:
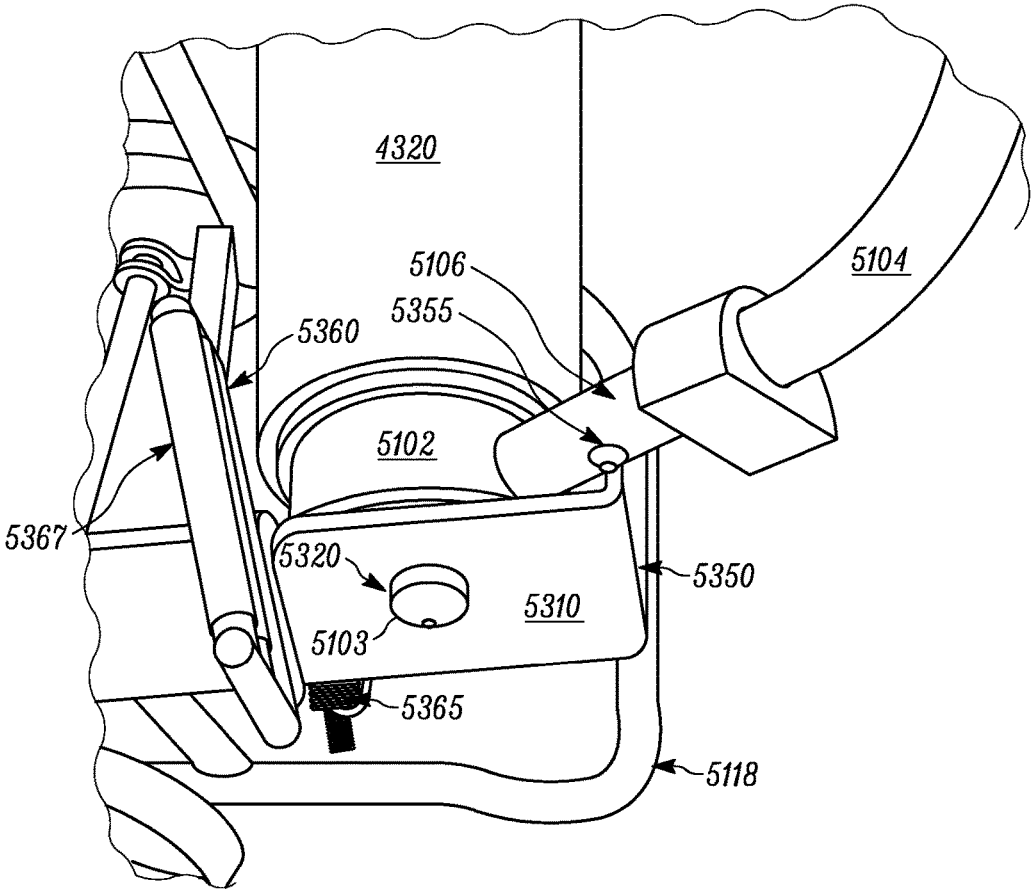
FIG. 54 comprises a perspective view of the mechanism for mounting a hand-held stretch film dispenser of FIG. 53 with a dispenser partially mounted therein as configured in accordance with various embodiments of the invention.
Figure 55:
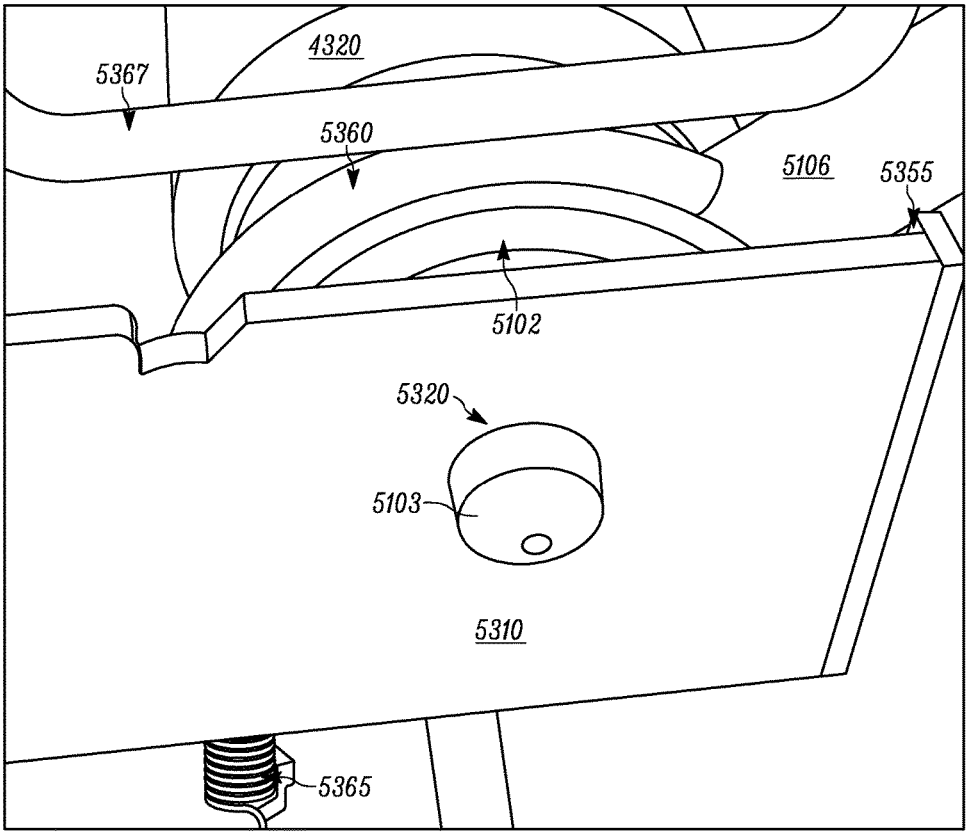
FIG. 55 comprises a perspective view of the mechanism for mounting a hand-held stretch film dispenser of FIG. 53 with a dispenser fully mounted therein as configured in accordance with various embodiments of the invention.
Figure 56:
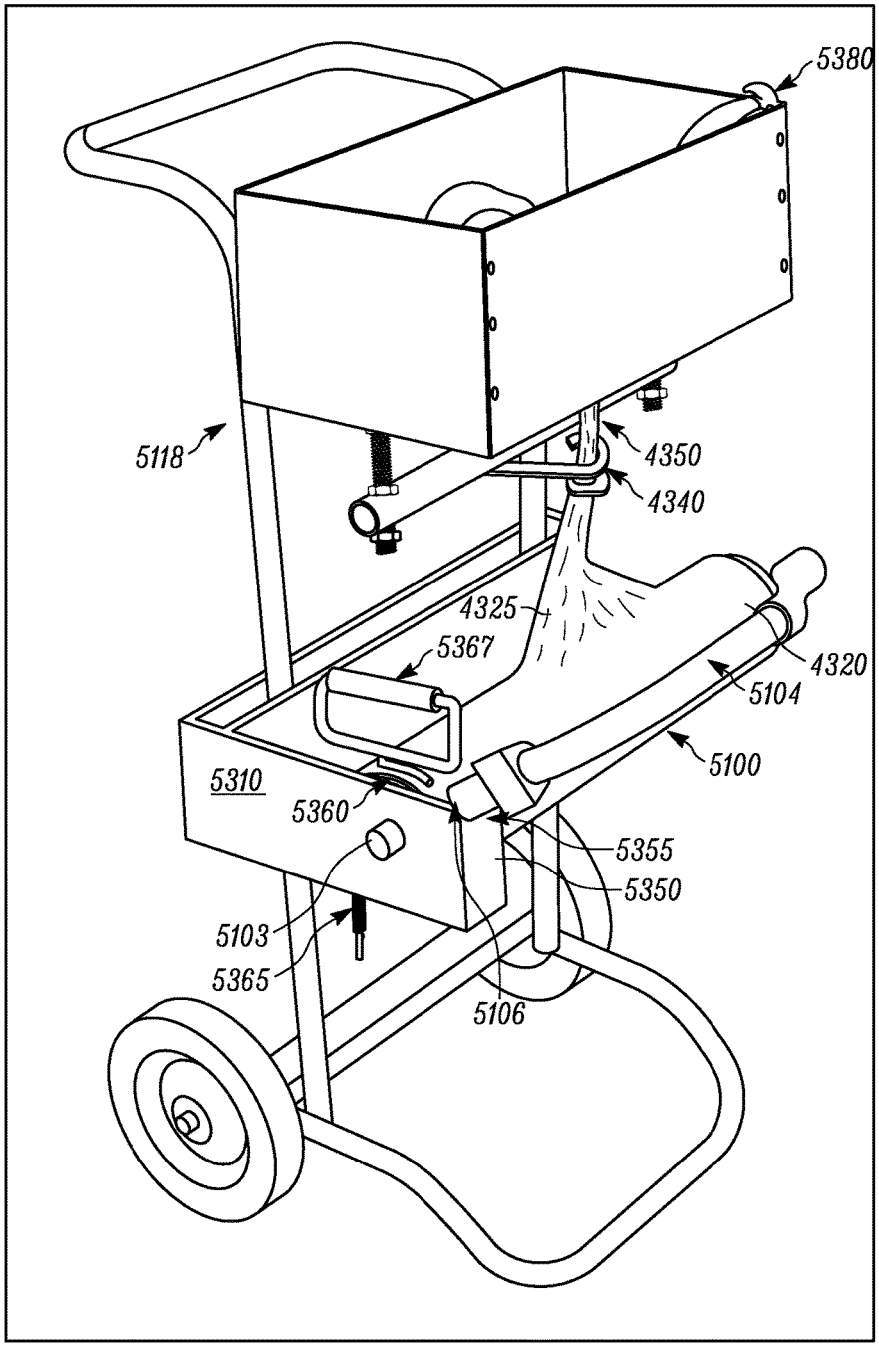
FIG. 56 comprises a perspective view of an example stretch film dispenser for creating string or rope, the dispenser having the mechanism for mounting a hand-held stretch film dispenser of FIG. 53 as configured in accordance with various embodiments of the invention.

In a further aspect, the carts illustrated in FIGS. 43-49 can be adapted to readily receive a hand-held stretch film dispenser such as that illustrated in FIG. 1 to mount the roll of stretch film for use with the roper device. One example of a dispenser support device is illustrated in FIGS. 50-52. In this example, a hand-held stretch film dispenser 5100 includes a rounded base portion 5102 out of which a handle 5104 extends. A cart 5118 supports a gathering device 4340 configured to engage, gather, and stretch the stretch film 4325 as it is pulled from the stretch film roll 4320 and through the gathering device 4340. The cart 5118 also supports a half-circle shaped bracket 5120 shaped to fit the rounded base portion 5102 of the dispenser 5100. A resilient clamp 5125 is mounted next to the bracket 5120 and sized to securely receive a base portion 5106 of the dispenser's handle 5104 that extends from the rounded base portion 5102. FIG. 51 illustrates where the dispenser's rounded base portion 5102 is engaging the half-circle shaped bracket 5120 prior to insertion of the handle's base portion 5106 into the clamp 5125. FIG. 52 illustrates the arrangement after insertion of the handle's base portion 5106 into the clamp 5125.

Another example approach to mounting a hand-held stretch film dispenser 5100 for use with a roper device will be described with reference to FIGS. 53-56. In this approach, the dispenser support device includes a first supporting surface 5310 defining a curved carve-out portion 5315 shaped to fit the rounded base portion 5102 of the dispenser 5100. The first supporting surface 5310 may also define an aperture 5320 shaped to receive a protrusion 5103 extending from the bottom of the dispenser's rounded base portion 5102 or provide passage for a screw or other fastening mechanism to facilitate mounting of the dispenser 5100 to the first supporting surface 5310. A second supporting surface 5350 is disposed approximately perpendicular to the first supporting surface 5310 and defines an indentation 5355 shaped to support the dispenser's handle 5104. A curved arm 5360 is mounted next to the curved carve-out portion 5315 of the first supporting surface 5310. The curved arm 5360 is shaped to fit the rounded base portion 5102 of the dispenser 5100 thereby locking it into engagement with the curved carve-out portion 5315 of the first supporting surface 5310. The curved arm 5360 is biased by a spring 5365 to pull the curved arm 5360 into engagement with the dispenser's rounded base portion 5102 after a user pulls the curved arm up and over the dispenser's rounded base portion 5102. A handle 5367 may be mounted to facilitate placement of the curved arm 5360.

Figure 57:
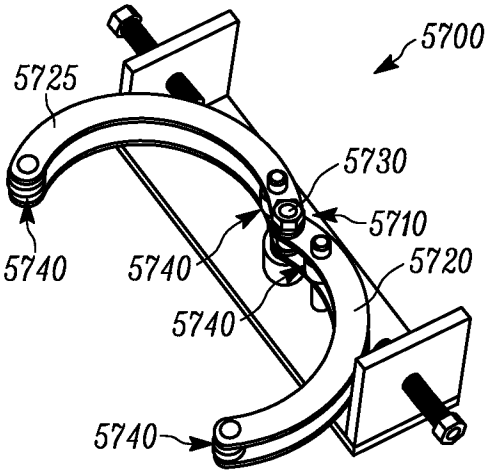
FIG. 57 comprises a perspective view of another example mechanism for mounting a hand-held stretch film dispenser as configured in accordance with various embodiments of the invention.
Figure 57:
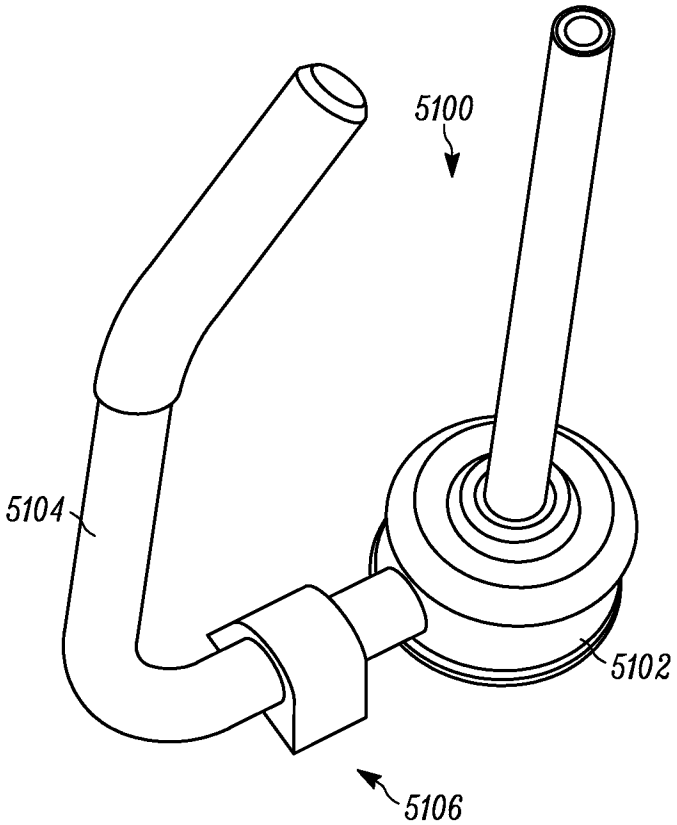
Figure 58:
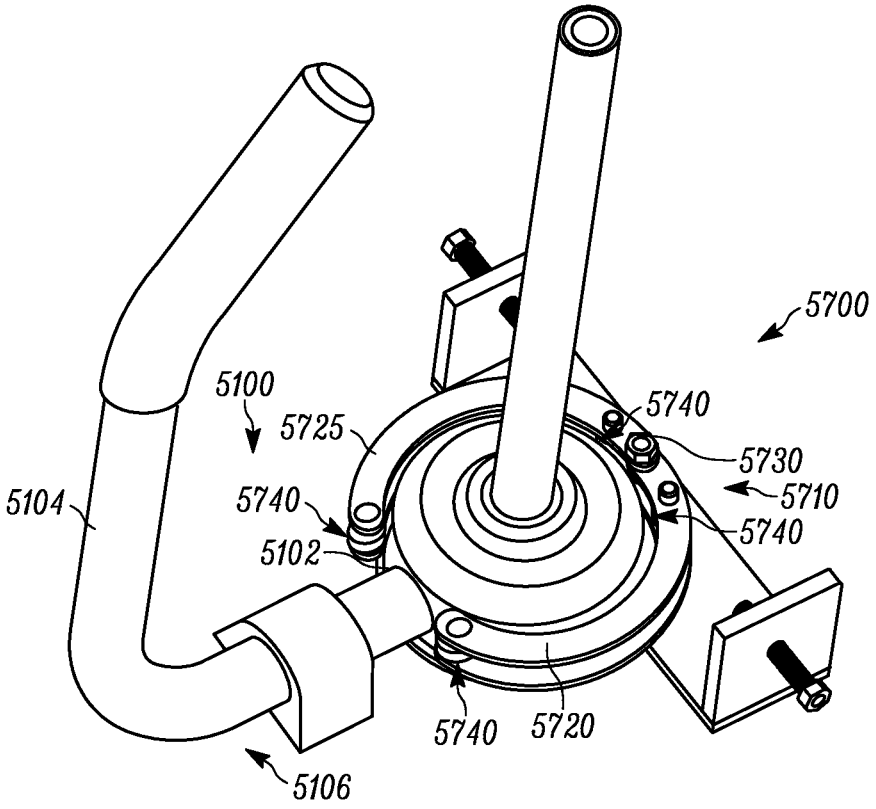
FIG. 58 comprises a perspective view of the mechanism for mounting a hand-held stretch film dispenser of FIG. 57 in a closed position.

Still another example approach to mounting a hand-held stretch film dispenser 5100 for use with a roper device will be described with reference to FIGS. 57 and 58. In this approach, the dispenser support device 5700 is mountable on a cart or other support for the roping device and includes a clamp 5710 having a first arm 5720 and a second arm 5725 mounted to be movable between an open position (illustrated in FIG. 57) and a closed position (illustrated in FIG. 58). When in a closed position, the clamp 5710 is configured to grip and support the base portion 5102 of the dispenser 5100. In the illustrated example, the first arm 5720 and the second arm 5725 are connected to rotate about a common hinge point 5730. The first arm 5720 and the second arm 5725 support rounded engagement elements 5740 that contact the base portion 5102 of the dispenser 5100 when the clamp 5710 is in the closed position. For instance, the clamp's arms 5720 and 5725 are typically designed such that engagement elements 5740 supported at portion of the arms 5720 and 5725 distal from the hinge point 5730 and contact the base portion on either side of the dispenser's handle base 5106. The clamp's arms 5720 and 5725 can be biased and locked into the closed position using any typical mechanical means including, for example, screw biasing or the like.

So configured, a load can be secured to a pallet using lower cost string or rope made from stretch film instead of metal or plastic strapping. The lower cost stretch film string or rope can be secured to the pallet using attachment devices, which themselves can be low cost and reused. Thus, shipment costs can be reduced without loss of performance in load security. Moreover, the stretch film string or rope can be applied to a pallet or load more quickly than typical strapping. Additionally, by stretching the stretch film into a string or rope configuration, less material can be used to secure the same load as compared to a typical use of stretch film without roping the material.

Those skilled in the art will recognize that a wide variety of modifications, alterations, and combinations can be made with respect to the above described embodiments without departing from the scope of the invention. For instance, the described steps used to create the string or rope from the stretch film can be performed more than once and in any order in any combination. Also, although the steps for creating the stretch film are described with respect to removing stretch film from a roll of same, the same steps could be applied in line with manufacturing of the stretch film instead of being done solely as an after-market adaptation to stretch film dispensed from a roll. In such an application, the rope created can be rolled or otherwise packaged and sold with or without clips for use in securing objects such as those secured to a pallet. Also, the various mechanical aspects described above can be mixed and combined in any way, and additional components can be added. For instance, a knife blade 5380 is mounted in the cart example of FIG. 56 to facilitate manual cutting of the string 4350 pulled through the roping device. Such a knife blade or equivalent cutting device could be added to any of the roping devices described above. Such modifications, alterations, and combinations are to be viewed as being within the ambit of the inventive concept.

What is claimed is:

1. An apparatus for applying a stretch film to an object, the apparatus comprising:

a support frame configured to support a roll of stretch film and dispense the stretch film in response to tension on the stretch film;

a first gathering device disposed to stretch and gather the stretch film into a string configured to wrap around the object;

a second gathering device disposed to receive the string, the second gathering device comprising a first roller disposed to stretch the string over at least a portion of a circumference of the first roller and a second roller biased against the first roller in a radial direction.

2. The apparatus of claim 1 further comprising an actuator connected to drive the first roller to pull the string from the first gathering device.

3. The apparatus of claim 1 further comprising a twisting element defining a twisting aperture having a width configured to engage the string after the string engages the first roller, wherein the twisting element is configured to be rotated to twist the string through engagement with the twisting aperture as the string passes through the twisting aperture.

4. The apparatus of claim 3 wherein the twisting element comprises a gear.

5. The apparatus of claim 4 wherein the twisting element comprises an eccentric aperture defined by the gear.

6. The apparatus of claim 5 wherein the gear comprises a bevel gear connected to be driven by an actuator connected to drive the first roller to pull the string from the first gathering device.

7. The apparatus of claim 1 wherein the support frame is configured to support a second roll of second stretch film and dispense the second stretch film in response to tension on the second stretch film, and wherein the first gathering device is disposed to stretch and gather the stretch film and the second stretch film into a single, combined string configured to wrap around the object.

8. The apparatus of claim 1 wherein the support frame comprises a dispenser support device configured to engage and support a base portion of a stretch film dispenser.

9. The apparatus of claim 8 wherein the dispenser support device comprises a half-circle shaped bracket shaped to fit the base portion of the stretch film dispenser.

10. The apparatus of claim 9 further comprising a resilient clamp is mounted next to the half-circle shaped bracket and sized to securely receive a portion of a handle of the stretch film dispenser.

11. The apparatus of claim 8 wherein the dispenser support device comprises a first supporting surface defining a curved carve-out portion shaped to fit the base portion of the stretch film dispenser.

12. The apparatus of claim 11 further comprising a second supporting surface disposed approximately perpendicular to the first supporting surface and defining an indentation shaped to support a handle of the stretch film dispenser.

13. The apparatus of claim 11 further comprising a curved arm mounted next to the curved carve-out portion of the first supporting surface and shaped to fit the base portion of the stretch film dispenser to lock it into engagement with the curved carve-out portion of the first supporting surface.

14. The apparatus of claim 8 wherein the dispenser support device comprises a clamp having a first arm and a second arm mounted to be movable between an open position and a closed position, wherein when in a closed position, the clamp is configured to grip and support the base portion of the stretch film dispenser.

* * * * *